US006574346B1

(12) United States Patent
Tanaka

(10) Patent No.: US 6,574,346 B1
(45) Date of Patent: Jun. 3, 2003

(54) BASS REPRODUCTION SPEAKER APPARATUS

(75) Inventor: Shoji Tanaka, Hyogo (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/557,476

(22) Filed: Apr. 24, 2000

(30) Foreign Application Priority Data

Apr. 26, 1999 (JP) ..... 11-117852
Nov. 25, 1999 (JP) ..... 11-333777

(51) Int. Cl.[7] ..... H04R 11/02
(52) U.S. Cl. ..... 381/421; 381/413
(58) Field of Search ..... 381/96, 412, 414, 381/417, 420, 422, 421, FOR 159, 396, 413

(56) References Cited

U.S. PATENT DOCUMENTS 2,810,021 A 10/1957 Brownscombe
4,607,382 A * 8/1986 Dijkstra et al. ..... 267/164
4,821,328 A * 4/1989 Drozdowski ..... 381/96
4,860,370 A * 8/1989 Grosbard ..... 381/197

* cited by examiner

*Primary Examiner*—Melur Ramakrishnaiah
*Assistant Examiner*—Brian Ensey
(74) *Attorney, Agent, or Firm*—Merchant & Gould, P.C.

(57) ABSTRACT

Negative stiffness is generated for a vibration system of a speaker unit by using a movable magnet attached to the vibration system of the speaker unit and also a ring-like stationary magnet arranged coaxially at the outer radius thereof in order to increase equivalently internal volume of a cabinet. In addition, an offset in the displacement direction of the vibration system of the speaker unit is detected with a Hall element and fed back to a power amplifier in order to correct the offset in the displacement direction of the vibration system of the speaker unit. As a result, a reliable and practical bass reproduction speaker apparatus can be obtained, and the speaker apparatus is noise-free and excellent in bass reproduction performance even with a cabinet of small capacity.

14 Claims, 21 Drawing Sheets

-------- Stiffness force of supporting system and air in cabinet
—-—-— Negative stiffness force
———— Total stiffness force

BASS REPRODUCTION SPEAKER APPARATUS

FIELD OF THE INVENTION

This invention relates to a bass reproduction speaker apparatus that provides improved bass reproduction performance even if the cabinet is small.

BACKGROUND OF THE INVENTION

Regarding the bass reproduction of a typical speaker, there is an inverse proportional relationship between the cabinet internal volume V, bass reproduction limit frequency fc, and efficiency $\mu$. Therefore, as commonly known, it is very difficult to reproduce lower frequencies efficiently in a small cabinet.

It has been also known that bass reproduction performance can be improved without concern for these constraints if negative stiffness is used to decrease air stiffness in the cabinet and increase equivalently the internal volume of the cabinet. Actually, however, there have been no suitable methods to achieve this purpose.

The following are conventional techniques disclosed to realize the concept in U.S. Pat. No. 2,810,021 patented on Oct. 15, 1957 (Low Frequency Loudspeaker), and in U.S. Pat. No. 4,607,382 patented on Aug. 19, 1986 (Electroacoustic Transducer Unit With Reduced Resonant Frequency And Mechanical Spring With Negative Spring Stiffness, Preferably Used In Such A Transducer Unit).

FIG. 17 shows a configuration of a conventional bass reproduction speaker apparatus disclosed in U.S. Pat. No. 2,810, 021.

In FIG. 17, 351 denotes a speaker unit, and the speaker unit 351 includes a field magnetic portion 351*a*, a frame 351*b*, a voice coil 351*c*, a damper 351*d*, an edge 351*e* and a diaphragm 351*f*. Numeral 352 denotes an airtight cabinet to which the speaker unit 351 is attached.

Numeral 358 denotes a supporter that is fixed to the cabinet 352. Springs 359*b* disposed on the inner wall of the supporter 358 press levers 359*c* in an inward direction. The levers 359*c* are supported by fulcrum grooves 359*d*. A rod 359*a* is attached to the upper part of the voice coil 351*c* of the speaker unit 351, and toggle pins 359*f* are entrapped between grooves 359*g* of the rod 359*a* and grooves 359*e* of the levers 359*c*.

A movable electrical contact 360*a* is provided at the upper part of the rod 359*a*, and the contact 360*a* is flexibly supported by a spring 360*c*. And a fixed electrical contact 360*b* is arranged to sandwich the movable electrical contact 360*a*. To these electrical contacts, an exhaust pump 360*d* and an intake pump 360*e* are connected.

A conventional bass reproduction speaker apparatus thus configured operates as follows.

The springs 359*b* press the toggle pins 359*f* in the inward direction through the levers 359*c*. Therefore, when the voice coil 351*c* is displaced and the toggle pins 359*f* lose the equilibrium, the toggle pins 359*f* are tilted further and press the rod 359*a* in the displacement direction.

When a vibration system including the voice coil 351*c* and the diaphragm 351*f* is displaced, the stiffness of a supporting system (the damper 351*d* and the edge 351*e*) and the stiffness of air in the cabinet 352 act to pull the vibration system back to the central position. However, the toggle mechanism including 359*a*–359*g* generates a force in the reverse direction, more specifically, the toggle mechanism acts to further push out the vibration system of the speaker unit 351 in the displacement direction.

In other words, the toggle mechanism including 359*a*–359*g* provides negative stiffness to the vibration system of the speaker unit 351. Since the toggle mechanism cancels and reduces the stiffness provided by the supporting system of the speaker unit 351 and of the air in the cabinet 352, the internal volume of the cabinet 352 is increased equivalently. This results in improvement of the bass reproduction performance. The principle of the equivalent increase of the cabinet internal volume due to negative stiffness and improvement in the bass reproduction performance will be described later in detail.

When this negative stiffness is greater than the stiffness of the supporting system of the speaker unit 351, the vibration system cannot stay at the inherent displacement central position due to a slight air leak from the cabinet 352 or the like, but it is offset in either displacement direction. The electrical contacts (360*a*, 360*b*) and the pumps (360*d*, 360*e*) serve to correct the offset.

More specifically, when the vibration system of the speaker unit 351 is offset forward, the movable electrical contact 360*a* contacts with the upper part of the stationary electrical contact 360*b*, and the exhaust pump 360*d* activates. As a result, air in the cabinet 352 is exhausted and the vibration system of the speaker unit 351 is pulled back to the inherent displacement central position. On the contrary, when the vibration system is offset backward, the movable electrical contact 360*a* contacts with the lower part of the stationary electrical contact 360*b*, and the intake pump 360*e* activates. As a result, air flows into the cabinet 352, and the vibration system of the speaker unit 351 is pushed back to the inherent displacement central position.

Sequentially, an offset in the displacement direction of the vibration system of the speaker unit 351 is corrected even when the negative stiffness is great.

However, the springs 359*b* in the above-mentioned configuration will have a mechanical fatigue since the negative stiffness is generated by the mechanical toggle mechanism including 359*a*–359*g*. Operation with large amplitude for a long time can cause a rupture. This will deteriorate the reliability. Moreover, the portions at which the toggle pins 359*f* and the levers 359*c* contact with each other generate abnormal noises. In addition, increased numbers of components make the apparatus complicated.

The apparatus inevitably will be more complicated and large-scaled since it requires pumps (360*d*, 360*e*) to correct an offset in the displacement direction of the vibration system, and the pumps cause noises in a case that negative stiffness is great.

Configurations of other conventional bass reproduction speaker apparatuses disclosed in U.S. Pat. No. 4,607,382 are shown in FIGS. 18 and 19. These speaker apparatuses are further developed though the basic principles thereof are identical to the first speaker apparatus.

In FIGS. 18 and 19, 451 denotes an electrodynamic speaker unit, and it includes a field magnetic portion 451*a*, a frame 451*b*, a voice coil 451*c*, a damper 451*d*, an edge 451*e*, and a diaphragm 451*f*. Numeral 452 denotes an airtight cabinet to which the speaker unit 451 is attached.

Numeral 451*i* denotes a ring to reinforce the diaphragm 451*f*, and the ring is attached to the outer rim of the diaphragm 451*f*. Numeral 454 denotes pairs of springs respectively composed of two warped plate springs opposing each other. While being compressed in the longitudinal direction, one end of each spring 454 is attached to a movable part supporting member 451*g* on the reinforcement ring 451*i*, and the other end is attached to the stationary part supporting member 452*a* that is fixed to the frame 451*b*. Two springs 454 are arranged longitudinally in a line centering the movable part supporting member 451*g*. In this example, three sets of spring pairs 454 arranged in a line are provided to be substantially rotationally symmetric about the central axis of the diaphragm 451*f*.

Two springs 454 should be arranged in a line on both sides of the movable part supporting member 451*g*. If there is only one pair of springs 454, a rotational force about the central axis will act on the reinforcement ring 451*i* (i.e., the diaphragm 451*f*, and thus, the supporting systems of the speaker unit 451 are subjected to stress and can be damaged.

Numeral 458 denotes a means to detect displacement of the diaphragm 451*f* from the central position of the vibration. U.S. Pat. No. 4,607,382 refers to detection methods including capacitive detection, inductive detection, optoelectrical detection, and pneumatic detection.

Numeral 459 denotes a controller to correct displacement of the diaphragm 451*f* from the central position for vibration, and it operates based on an output signal from the detector 458. In FIG. 18B, 460 denotes an intake-exhaust pump, which operates based on an output signal from the controller 459. In FIG. 19B, the controller 459 is a high-power amplifier provided aside from an ordinary power amplifier that amplifies a source signal, and the controller 459 is connected with the speaker unit 451.

Operations of the conventional bass reproduction speaker apparatus thus configured are explained below, by further referring to FIGS. 20 and 21.

FIGS. 20 and 21 show the action of negative stiffness provided by the springs 454. In FIG. 20, 452*a* denotes a stationary part supporting member, 451*g* denotes a movable part supporting member and 454 denotes a pair of springs attached with a compressive force of the supporting members. In other words, FIG. 20 shows a pair of springs 454 in FIGS. 18 and 19.

When the movable part supporting member 451*g* is positioned at the center in the vibration displacement direction x(x=0), repulsion of the springs 454 acting between the movable part supporting member 451*g* and the stationary part supporting member 452*a* is directed perpendicular to the x direction, and a vector component of the force in the x direction becomes zero. As a result, no forces in the x direction are generated.

However, when the position of the movable part supporting member 451*g* is displaced from the center, i.e., when the movable part supporting member 451*g* moves, for example, to the Δx position in FIG. 20, the direction of the repulsion of the springs 454 acting between the movable part supporting member 451*g* and the stationary part supporting member 452*a* is not perpendicular to the x direction. As a result, a vector component of a force in the x direction is generated and a force to push the movable part supporting member 451*g* in the Δx direction is generated.

Here, F1 indicates a force applied to the vibration system of the speaker unit 451 by the supporting system of the speaker unit (e.g., the edge 451*e*) and by the air enclosed in the cabinet 452 when the movable part supporting member 451*g* is displaced by Δx. In such a case, F1 is a force to pull the movable part supporting member 451*g* back to the position of x=0, so apparently, the polarity of the stiffness of the force F1 is positive.

Similarly, F2 indicates a force applied to the vibration system by the springs 454 when the movable part supporting member 451*g* is displaced by Δx. In such a case, F2 is a force to further push the movable part supporting member 451*g* in the displacement direction. Therefore, the direction of F2 is reverse to the direction of F1, and the polarity of the stiffness of the force of F2 is negative.

In this way, the springs 454 generate negative stiffness. The action of this negative stiffness is shown in FIG. 21. In FIG. 21, the broken line indicates the relationship between an x direction displacement and a force that positive stiffness of the speaker unit supporting system and of the air in the cabinet provides to the vibration system, i.e., the movable part supporting member 451*g*. The dashed line indicates the relationship between the x direction displacement and a force that negative stiffness of the springs 454 provides to the movable part supporting member 451*g*. The solid line indicates the relationship between the x direction displacement and a force that the total stiffness including the above-identified stiffness provides to the movable part supporting member 451*g*.

The positive stiffness is F1/Δx, and it corresponds to the gradient of the broken line. The negative stiffness is F2/Δx, and it corresponds to the gradient of the dashed line. The total stiffness is Ft/Δx, i.e. (F1−F2)/Δx, and it corresponds to the gradient of the solid line. The gradient of the solid line is smaller than that of the broken line, and this implies that the total stiffness is decreased. As mentioned above, stiffness finally applied to the movable part supporting member 451*g* is decreased due to the action of the negative stiffness, and the effect is equivalent to the case where air stiffness in the cabinet is decreased. Since the stiffness of the air in the cabinet is inversely proportional to the internal volume of the cabinet, the effect is equivalent to the case where the internal volume of the cabinet 452 is increased.

To obtain this effect sufficiently, the negative stiffness of the springs 454 should be increased. In this case, however, the supporting system of the speaker unit 451 yields to this negative stiffness, and the vibration system of the speaker unit 451 is completely offset to a position out of the displacement central portion of x=0, so that normal operations will be hindered.

Though the total stiffness composed of the stiffness of the air in the cabinet 452 and of the stiffness of the supporting system of the speaker unit 451 is greater than the negative stiffness, a trace of air is leaked inevitably from the cabinet 452 or from the diaphragm 451*f*. Therefore, if the negative stiffness exceeds the stiffness of the supporting system of the speaker unit 451, the vibration system cannot stay at the displacement central position.

To prevent and correct this, the detector 458, the controller 459 and the intake-exhaust pump 460 are provided as shown in FIGS. 18 and 19.

In the configuration exemplified in FIGS. 18A and 18B, when the average vibration displacement center of the vibration system of the speaker unit 451 is offset forward from the inherent central position (a position of x=0 in FIG. 20), the detector 458 detects this displacement offset and generates a signal to send an output signal to the controller 459. The controller 459 actuates the intake-exhaust pump 460 to exhaust the air in the cabinet 452, so that the diaphragm 451*f* of the speaker unit 451 is pulled back to its inherent displacement central position.

On the contrary, when the vibration system is offset backward, the intake-exhaust pump 460 is actuated to intake air into the cabinet 452, so that the vibration system of the speaker unit 451 is pushed back to its inherent displacement central position.

In the configuration shown in FIGS. 19A and 19B, when the vibration system of the speaker unit 451 is offset forward, the controller 459, i.e., a power amplifier, supplies current to the voice coil 451*c* of the speaker unit 451 in order to pull the vibration system back to its inherent displacement central position. On the contrary, when the vibration system is offset backward, the controller 459 supplies current in the inverse direction to the voice coil 451*c* of the speaker unit 451 in order to push the vibration system back to its inherent displacement central position.

In FIGS. 19A and 19B, the voice coil 451*c* should have a double-voice coil configuration composed of two voice coils, i.e. a voice coil to run a current of this controller 459 and an original voice coil to reproduce a source signal.

In the conventional bass reproduction speaker apparatuses configured as shown in FIGS. 18 and 19, the bass reproduction performance can be improved by increasing equivalently the internal volume of the cabinet by using negative stiffness while correcting an offset in the displacement direction of the vibration system of the speaker unit 451. Details of the principle of the equivalent increase of the cabinet internal volume due to negative stiffness and improvement in the bass reproduction performance are described later in the embodiments of the present invention.

However, in the above-mentioned configurations of the conventional techniques, the intake-exhaust pump or an additional power amplifier other than the power amplifier for source signal reproduction is required to correct an offset in the displacement direction of the vibration system of the speaker unit 451. As a result, the apparatuses will be complicated and large, and the cost will rise. Moreover, the springs 454 have a mechanic fatigue easily, resulting in poor reliability.

In conclusion, the bass reproduction speaker apparatuses disclosed in U.S. Pat. No. 2,810,021 and 4,607,382 are to increase equivalently the cabinet internal volume and to improve bass reproduction performance. However, these apparatuses suffer from many problems as mentioned above, and they are not practical.

SUMMARY OF THE INVENTION

The present invention aims to solve the above-mentioned problems of the conventional techniques by providing a bass reproduction speaker apparatus that is reliable, inexpensive, simple and practical. The bass reproduction speaker apparatus has excellent bass reproduction performance since the internal volume of the cabinet is increased equivalently.

For achieving this purpose, the present invention has the following configuration.

More specifically, a first bass reproduction speaker apparatus of the present invention includes a speaker unit having a vibration system, a cabinet to which the speaker unit is attached, a movable magnet that moves together with the vibration system of the speaker unit, and a stationary magnet, in which the movable magnet and the stationary magnet are configured to generate negative stiffness to the vibration system of the speaker unit. Accordingly, negative stiffness can be generated without using any mechanical means or any contacts, so that no mechanical fatigues or noises will occur. Therefore, a reliable, simple and practical bass reproduction speaker apparatus can be provided.

In the first bass reproduction speaker apparatus, it is preferable that the stationary magnet is ring-like and the movable magnet is arranged at the inner radius of the stationary magnet. Accordingly, only two magnets are required to generate negative stiffness, and thus, the mechanism for generating negative stiffness can be simplified. Furthermore, as the stationary magnet can be made bigger, extremely great negative stiffness can be obtained easily. Moreover, a characteristic curve of the displacement-force of the generated negative stiffness is linear. Therefore, a bass reproduction speaker apparatus that is simple, useful and excellent in the performance can be obtained.

It is preferable in the first bass reproduction speaker apparatus that the movable magnet and the stationary magnet are configured so that the generated negative stiffness is decreased before the displacement of the vibration system of the speaker unit reaches its maximum. Accordingly, the vibration system of the speaker unit is braked before the maximum amplitude is obtained. As a result, no abrupt tension will be applied to the supporting system in a case where excessive input is applied to the speaker unit, and a bass reproduction speaker apparatus resistant to excessive input is obtainable.

In the first bass reproduction speaker apparatus, it is preferable that a detector to generate a signal according to the displacement of the vibration system of the speaker unit is provided to feed back the signal from the detector to a power amplifier for driving the speaker unit in order to correct an offset in the displacement direction of the vibration system of the speaker unit. Accordingly, the speaker apparatus operates stably even when the generated negative stiffness is greater than the stiffness of the supporting system of the speaker unit. And thus, a bass reproduction speaker apparatus having further excellent bass reproduction performance can be obtained, with its equivalent internal volume of the cabinet being made extremely large.

Here, it is preferable that the detector includes a Hall element. Accordingly, the means to detect an offset in the displacement direction of the vibration system of the speaker unit can be simplified.

In the first bass reproduction speaker apparatus, it is preferable that the speaker apparatus has a holder to hold the vibration system of the speaker unit around the central position in the displacement direction when the speaker apparatus does not operate. Accordingly, the vibration system of the speaker unit is prevented from being offset to one side for a long time when the bass reproduction speaker apparatus does not operate, so that stress applied to the edge or the damper can be reduced. Therefore, a long-life bass reproduction speaker apparatus with less change over time can be provided.

In the first bass reproduction speaker apparatus, it is preferable that the stationary magnet is an electromagnet. Accordingly, the generated negative stiffness can be controlled by increasing or decreasing current running through the electromagnet. Sequentially, a bass reproduction speaker apparatus with variable fundamental resonance frequencies can be obtained. Moreover, the generation of the negative stiffness can be prevented by stopping the energizing of the electromagnet when the bass reproduction speaker apparatus does not operate, and thus, a long-life bass reproduction speaker apparatus with less change over time can be provided.

A second bass reproduction speaker apparatus includes a speaker unit having a vibration system, a means to provide negative stiffness to the vibration system of the speaker unit, a cabinet to which the speaker unit is attached, a detector to generate a signal according to displacement of the vibration system of the speaker unit, and a feedback circuit to feed back the signal from the detector to a power amplifier that supplies source signal power to drive the speaker unit. The power amplifier supplies power to the speaker unit in order to correct an offset in the displacement direction of the vibration system of the speaker unit along with source signal power. Accordingly, the speaker unit is servoed to constantly correct even a slight offset in the displacement direction of the vibration system and to hold the vibration system at its inherent central position in the displacement direction. As a result, the average displacement central position of the vibration system is held at its inherent central position even if the negative stiffness is great, and thus, extremely stable operation can be obtained. Furthermore, unlike the conventional apparatuses, there is no need to separately provide an intake-exhaust pump or a power amplifier for control in order to correct an offset in the displacement direction of the vibration system. Therefore, the present invention can provide a bass reproduction speaker apparatus having a simple and practical configuration at a low cost, and the apparatus has excellent bass reproduction performance.

In the second bass reproduction speaker apparatus, it is preferable that the detector includes a movable magnet that moves together with the vibration system of the speaker unit, and a Hall element to detect magnetism of the movable magnet. Accordingly, a single element can distinguish the rise and fall in displacement of the vibration system of the speaker unit. Therefore, a bass reproduction speaker apparatus with a simply configured detector is provided.

In the second bass reproduction speaker apparatus, the means to provide negative stiffness can be composed of springs that are attached at plural positions in a compressed state between the parts around the central position of the vibration system of the speaker unit and in the vicinity of the outer rim of the speaker unit or the cabinet, and the springs are attached with a substantial symmetry about a central axis. Accordingly, the springs can be made longer and the mechanical fatigue is reduced. Therefore, a bass reproduction speaker apparatus with improved reliability can be provided.

Alternatively in the second bass reproduction speaker apparatus, the means to provide negative stiffness can be composed of a movable magnet that moves together with the vibration system of the speaker unit and a stationary magnet to provide a force in the displacement direction of the vibration system to the movable magnet. Since the negative stiffness is generated without using any mechanical means, no mechanical fatigue will occur in this example. Therefore, a bass reproduction speaker apparatus with further improved reliability can be provided.

In the second bass reproduction speaker apparatus, it is preferable that a holder is provided to hold the vibration system of the speaker unit around the central position in the displacement direction during inoperative conditions. Accordingly, the vibration system of the speaker unit is prevented from being offset to one side in the displacement direction for a long time when the bass reproduction speaker apparatus does not operate, and thus, the supporting system and the springs of the speaker unit are not subjected to stress over a long time. Therefore, a long-life bass reproduction speaker apparatus with less change over time can be provided.

It is preferable that the holder includes a self-contained solenoid. Accordingly, the vibration system of the speaker unit can be held around the central position in the displacement direction and the holding is released in instantaneous operations. Therefore, a bass reproduction speaker apparatus that starts operating promptly is provided.

It is further preferable that a return current of the self-contained solenoid is supplied by discharging from a capacitor while an operation current of the self-contained solenoid is supplied through the same capacitor. Accordingly, the vibration system of the speaker unit can be held around the central position in the displacement direction even when the power supply is cut off suddenly during the operation of the bass reproduction speaker apparatus. Therefore, a bass reproduction speaker apparatus with improved safety can be provided.

In the second bass reproduction speaker apparatus, it is preferable that the negative stiffness provided by the above-mentioned means is reduced when the speaker apparatus does not operate. Accordingly, tension applied to the supporting system of the speaker unit during inoperative conditions can be reduced, and a long-life bass reproduction speaker apparatus with less change over time is provided.

In the second bass reproduction speaker apparatus, it is also preferable that the negative stiffness provided by the above-mentioned means is variable. Accordingly, the generated negative stiffness can be adjusted so that the fundamental resonance frequency of the bass reproduction speaker apparatus can be adjusted. Therefore, a bass reproduction speaker apparatus with a variable bass characteristic can be provided.

As mentioned above, the present invention provides a bass reproduction speaker apparatus with a simple configuration at a low cost. The apparatus is reliable and practical, and it has excellent bass reproduction performance. Therefore, the present invention has a great value from the viewpoint of utility.

BRIEF DESCRIPTION OF THE DRAWINGS

FIGS. 9A and 9B show a configuration of a bass reproduction speaker apparatus in a sixth embodiment of the present invention, in which FIG. 9A is a front view, and FIG. 9B is a cross-sectional view.

FIGS. 11A and 11B show a configuration of a bass reproduction speaker apparatus in a seventh embodiment of the present invention, in which FIG. 11A is a front view, and FIG. 11B is a cross-sectional view.

FIGS. 12A and 12B show a configuration of a bass reproduction speaker apparatus in an eighth embodiment of the present invention, in which FIG. 12A is a front view, and FIG. 12B is a cross-sectional view.

FIGS. 13A and 13B show a configuration of a bass reproduction speaker apparatus in a ninth embodiment of the present invention, in which FIG. 13A is a front view, and FIG. 13B is a cross-sectional view.

FIGS. 16A and 16B show a configuration of a bass reproduction speaker apparatus in a tenth embodiment of the present invention, in which FIG. 16A is a front view, and FIG. 16B is a cross-sectional view.

FIGS. 18A and 18B show a configuration of a conventional bass reproduction speaker apparatus, in which FIG. 18A is a front view, and FIG. 18B is a cross-sectional view.

FIGS. 19A and 19B show a configuration of another conventional bass reproduction speaker apparatus, in which FIG. 19A is a front view, and FIG. 19B is a cross-sectional view.

DETAILED DESCRIPTION OF THE INVENTION

Bass reproduction speaker apparatuses of the present invention will be explained below by referring to the first to tenth embodiments.

(First Embodiment)

Figure 1:
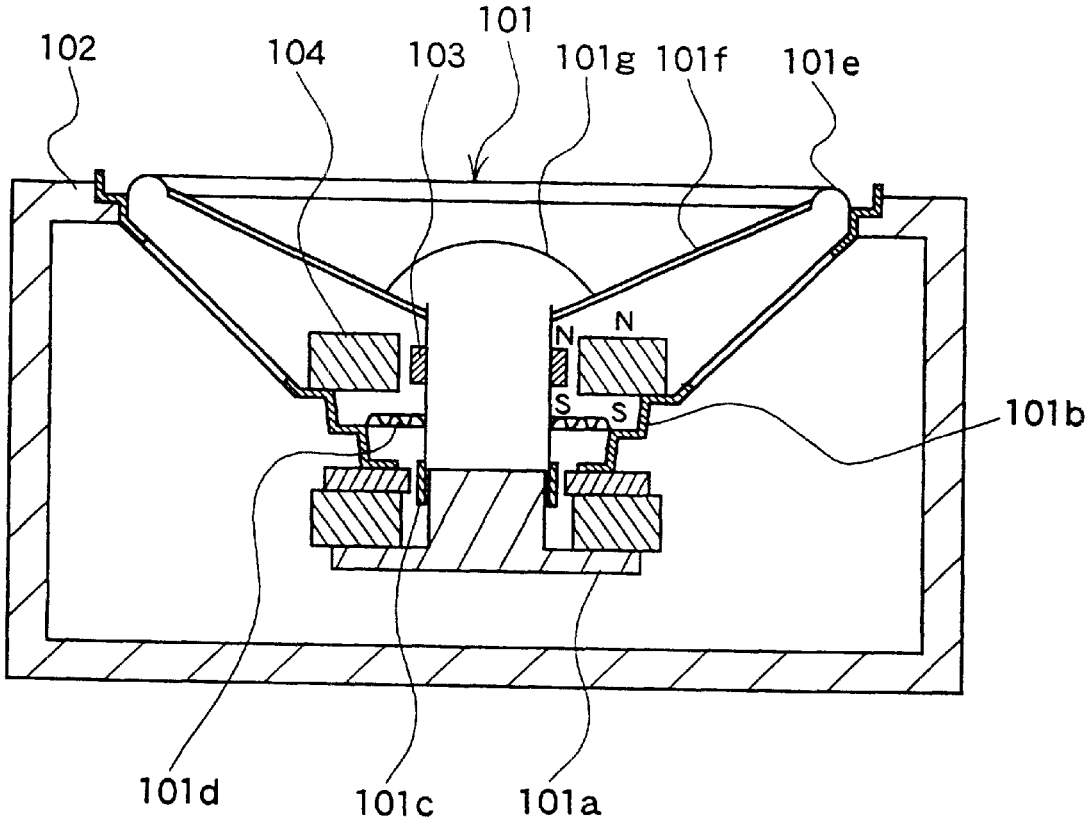
FIG. 1 is a cross-sectional view to show a configuration of a bass reproduction speaker apparatus in a first embodiment of the present invention.

FIG. 1 shows a configuration of a bass reproduction speaker apparatus in the first embodiment. In FIG. 1, a speaker unit 101, including a field magnetic portion 101*a*, a frame 101*b*, a voice coil 101*c*, a damper 101*d*, an edge 101*e*, a diaphragm 101*f* and a dust cap 101*g*, is attached to a cabinet 102. A ring-like movable magnet 103 attached to the voice coil 101*c* moves together with a vibration system including the voice coil 101*c*, the diaphragm 101*f* and the dust cap 101*g*.

A ring-like stationary magnet 104 is attached to the frame 101*b*. The magnets (103, 104) are arranged coaxially so that the movable magnet 103 is located at the central position in the thickness direction of the stationary magnet 104 (displacement direction of the vibration system) inside the stationary magnet 104 when the vibration system is at the central position in the vibration displacement direction. The movable magnet 103 and the stationary magnets 104 are magnetized with homopolarity in the thickness direction and the magnets repel each other. Thus, the movable magnet 103 and the stationary magnets 104 provide a force for the vibration system to escape from the central position, i.e., the magnets provide negative stiffness to the vibration system of the speaker unit 101.

Exemplary materials and dimensions of the bass reproduction speaker apparatus are specifically explained below.

The caliber of the speaker unit 101 is 18 cm. The field magnetic portion 101*a* is made of ferrite magnet 70 mm in diameter. The frame 101*b* is 18 cm in caliber and it is made of a steel plate. The voice coil 101*c* has a caliber (nominal diameter) of 19 mm (the outer diameter of a practical voice coil bobbin portion is about 20 mm). The edge 101*e* made of urethane foam has an up-roll shape. The diaphragm 101*f* is a paper cone. The dust cap 101*g* is made of paper.

The cabinet 102 is a small airtight enclosure with an internal volume of 10 liters.

The movable magnet 103 is 28 mm in outer diameter, 20 mm in inner diameter and 2.5 mm in thickness, and it is made of neodymium having a magnetic energy product of 30M·G·0e (megagauss oersted). The stationary magnet 104 is 70 mm in outer diameter, 32 mm in inner diameter and 15 mm in thickness, and it is made of ferrite.

In the above-mentioned configuration, the negative stiffness can be generated without using any mechanical means, or without any contacts. As a result, neither mechanical fatigue or noise will occur and the apparatus has an improved reliability. In addition, the speaker apparatus has a simple configuration since the negative stiffness is provided by only two magnets (103 and 104).

The configuration is useful also for providing effects in equivalently increasing the cabinet internal volume and in improving the bass reproduction performance. More specifically, the negative stiffness serves to substantially double the internal volume of the cabinet 102 and to extend the fundamental resonance frequency (bass reproduction limit frequency) from 96 Hz to 81 Hz.

The following is a principle of equivalent increase in cabinet internal volume due to negative stiffness and also improvement in the bass reproduction performance.

When the effective vibration mass of the speaker unit is M and the fundamental resonance frequency in a single free-air state is f0, stiffness Ks of the supporting system (e.g., the damper and the edge) of the speaker unit is represented as follows:

$$Ks=M\times(2\pi f0)^2. \qquad \text{Equation 1}$$

When the effective vibration radius of the speaker unit is a, the air acoustic velocity is c, the air density is ρ, and the cabinet internal volume is V, stiffness Kc provided by air in the cabinet to the vibration system of the speaker unit is represented by $$Kc=\rho c^2(\pi a)^2/V. \qquad \text{Equation 2}$$

When the speaker unit is attached to a cabinet, the vibration system of the speaker unit is subjected to stiffness of Ks+Kc. When the fundamental resonance frequency at this time is f1, the relationship is represented as follows:

$$f1=(Ks+Kc)^{1/2}/2\pi M^{1/2}. \qquad \text{Equation 3}$$

When the level of the negative stiffness is determined to be Kn, the stiffness acting on the vibration system of the speaker unit is Ks+Kc−Kn. This means that the air stiffness in the cabinet converts from Kc to Kc−Kn. The air stiffness in the cabinet is inversely proportional to the internal volume as given by Equation 2. Therefore, this is equivalent to increase of the cabinet internal volume from 1/Kc to 1/(Kc−Kn).

Figure 2:
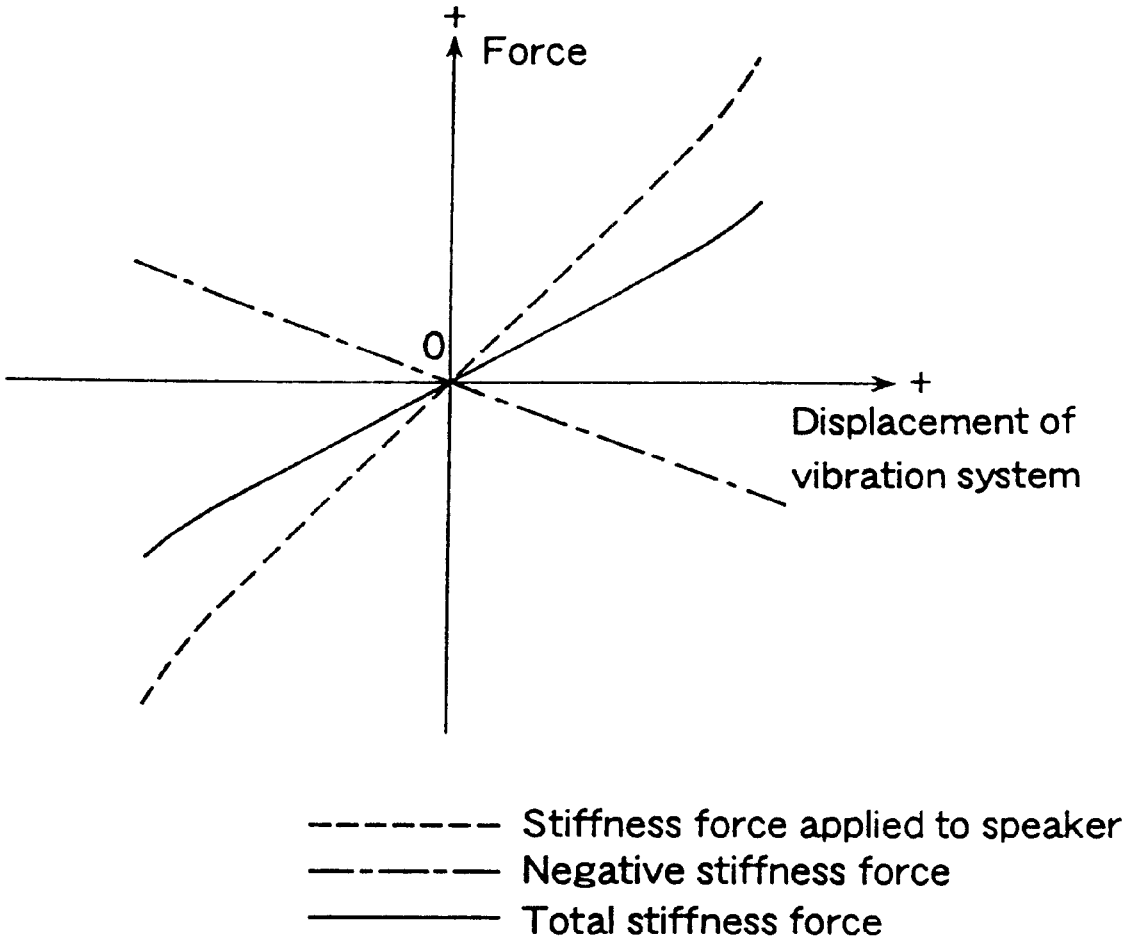
FIG. 2 is a graph including characteristic curves of vibration system displacement-stiffness force, illustrating a principle to improve bass reproduction performance of the bass reproduction speaker apparatus in the first embodiment.

FIG. 2 shows the relationship between stiffness forces of the speaker unit attached to a cabinet and displacement of the vibration system. The broken line indicates a stiffness force acting on the vibration system, the dashed line indicates a negative stiffness force, and the solid line indicates total stiffness force of the two forces. "Stiffness" can be paraphrased as a spring constant, and it corresponds to the inclination of the respective curves of the displacement-force. In other words, a gentler curve in the graph indicates that the stiffness is small and the vibration system is easier to move.

Since the negative stiffness acts, the fundamental resonance frequency of the speaker unit attached to the cabinet will be represented as follows:

$$f1=(Ks+Kc-Kn)^{1/2}/2\pi M^{1/2}. \quad \text{Equation 4}$$

The fundamental resonance frequency is lowered by $\{(Ks+Kc-Kn)/(Ks+Kc)\}^{1/2}$ times, namely, the bass reproduction limit frequency is extended in this range and the bass reproduction performance is improved.

If the technique of the negative stiffness is not used, the effective vibration mass should be increased or the effective vibration area should be decreased to lower the fundamental resonance frequency, and this will lower the efficiency. Negative stiffness can lower the fundamental resonance frequency without changing the effective vibration mass or area, so the bass reproduction can be extended without lowering the efficiency.

If the negative stiffness Kn is considerably increased to exceed Ks, the vibration system cannot stay at the central position but it is offset immediately to one side when the speaker unit is used alone without being attached to a cabinet. In other words, the supporting system of the speaker unit yields to the negative stiffness. Since an air leak cannot be prevented completely even if the speaker unit is attached to a cabinet, the vibration system of the speaker unit will be displaced from the central position and offset gradually.

Therefore, when the negative stiffness Kn is greater than the stiffness Ks of the supporting system, a means to correct the offset of the vibration system is required. The solutions will be explained later in the present specification.

The effects of the equivalent increase in the cabinet internal volume in this embodiment and improvement in the bass reproduction performance will be explained here with calculations following the above-mentioned principle.

In this embodiment, the fundamental resonance frequency of the speaker unit 101 (with a movable magnet 103) is 60 Hz, and the effective vibration mass is 15 g. The effective vibration radius is 70 mm. That is, the supporting system stiffness Ks of the speaker unit is 2130 (N/m) given by the Equation 1. The stiffness Kc provided by the air in the cabinet 102 is 3290 (N/m) given by the Equation 2. That is, Ks+Kc=5420 (N/m). When the speaker unit 101 is attached to the cabinet 102 without a stationary magnet 104, the fundamental resonance frequency f1 of the speaker unit 101 is 96 Hz given by the Equation 3 (identical to the measured value).

The fundamental resonance frequency f1 becomes 81 Hz by providing the negative stiffness Kn, Ks+Kc−Kn=3820 (N/m) when calculated back based on the Equation 4, and thus, Kn=5420−3820=1600 (N/m). It corresponds to that the stiffness of the air in the cabinet 102 is decreased from Kc=3290 (N/m) to Kc−Kn=3290−1600=1690(N/m). As the stiffness of the air in the cabinet is inversely proportional to the internal volume, this is equivalent to that the internal volume of the cabinet 102 being increased in proportions from 1/3290 to 1/1690. In other words, the internal volume of the cabinet 102 substantially doubles in this embodiment.

As mentioned above, the first embodiment provides a bass reproduction speaker apparatus that is reliable, practical, simple, and the speaker apparatus has excellent bass reproduction performance.

Figure 3:
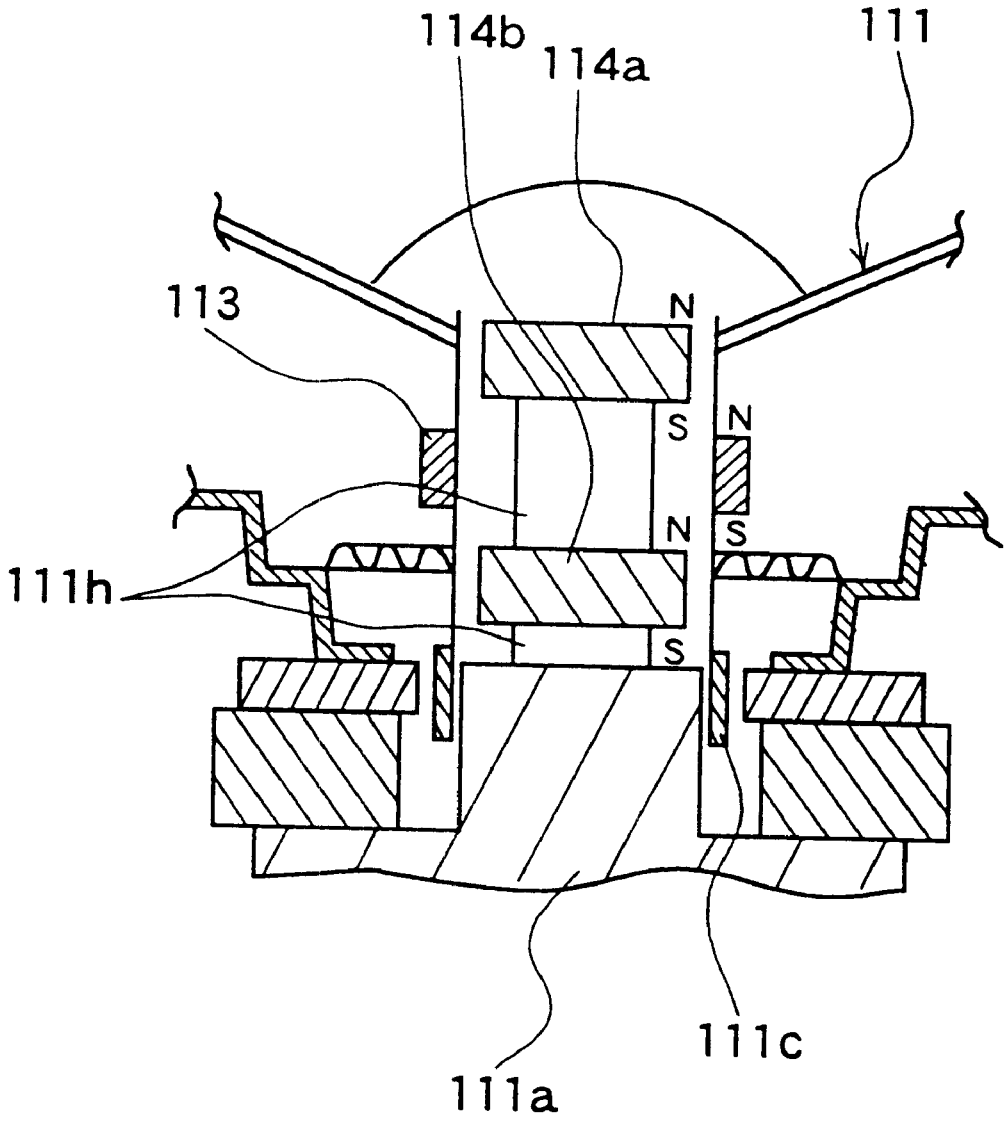
FIG. 3 is a cross-sectional view to show a configuration of a movable magnet and stationary magnet of another bass reproduction speaker apparatus in the first embodiment of the present invention.
Figure 4:
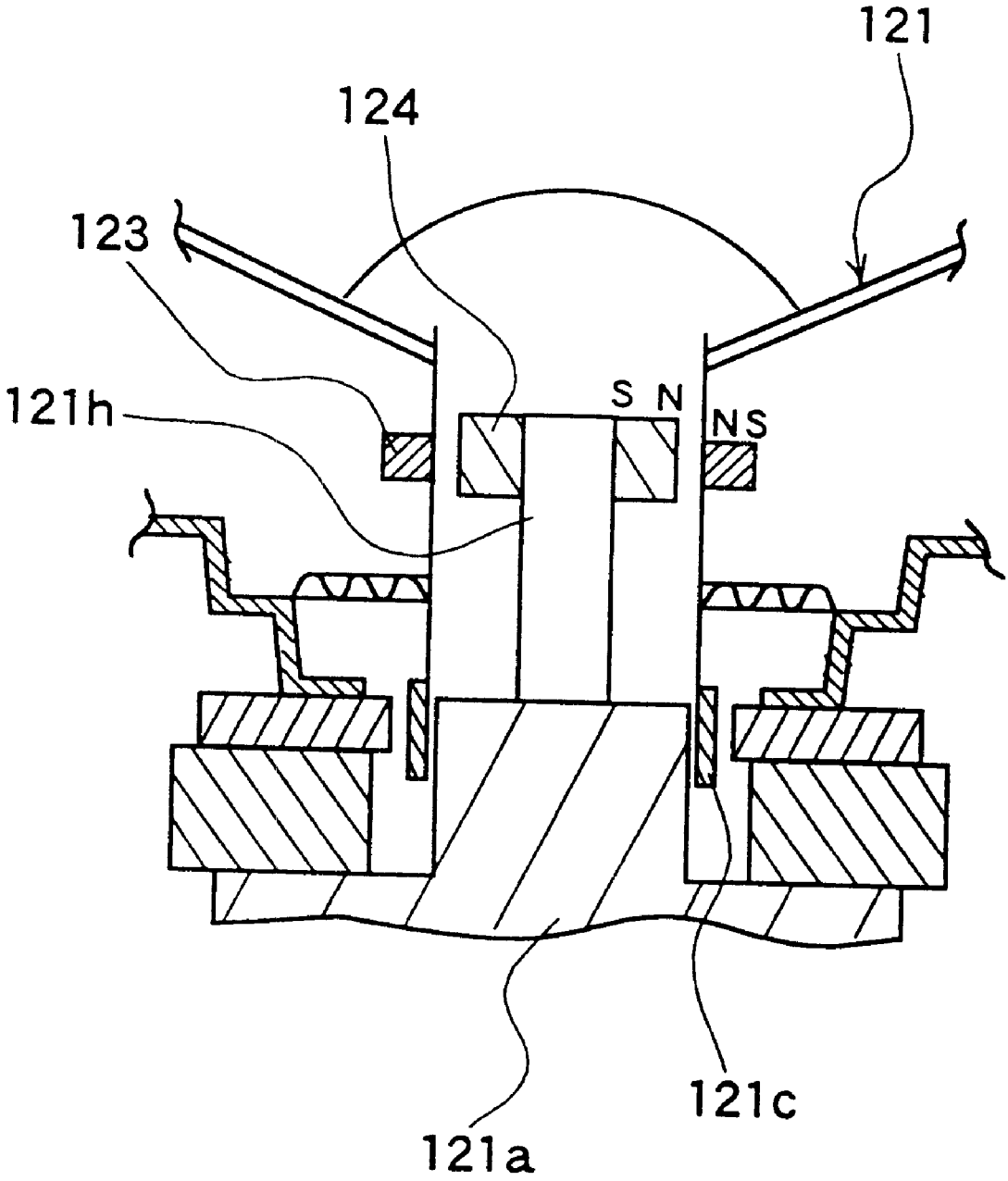
FIG. 4 is a cross-sectional view to show a configuration of a movable magnet and stationary magnet of a third bass reproduction speaker apparatus in the first embodiment of the present invention.

In the first embodiment, the movable magnet 103 and the stationary magnet 104 are configured as mentioned above, but the configuration can be varied. FIGS. 3 and 4 exemplify other bass reproduction speaker apparatuses.

A speaker unit 111 shown in FIG. 3 includes a ring-like movable magnet 113 attached to a voice coil 111*c* and two disc-like stationary magnets (114*a*, 114*b*). The stationary magnets (114*a*, 114*b*) are arranged at symmetrical positions in the thickness direction at the inner radius of the movable magnet 113 (i.e., the stationary magnets 114*a* and 114*b* are positioned at an equal distance from the movable magnet 113). The stationary magnets (114*a*, 114*b*) are attached at the upper part of a field magnetic portion 111*a* with a supporter 111*h*. The respective magnets 113, 114*a*, and 114*b* are magnetized with homopolarity in the thickness direction. The stationary magnets 114*a* and 114*b* generate attraction in the direction to pull the movable magnet 113 from the central position, and thus, negative stiffness is generated.

A speaker unit 121 shown in FIG. 4 includes a ring-like movable magnet 123 attached to a voice coil 121*c* and a ring-like stationary magnet 124 arranged at the center of the inner radius of the movable magnet 123. The stationary magnet 124 is attached to the upper part of a field magnetic portion 121*a* with a supporter 121*h*. In this example, the movable magnet 123 and the stationary magnet 124 are magnetized reversely in the radial direction. The movable magnet 123 and the stationary magnet 124 generate forces repelling each other, and thus, negative stiffness is generated.

Advantages such as miniaturization of the components are obtainable by arranging a stationary magnet at the inner radius of a movable magnet. As mentioned above, the configuration shown in FIG. 1 requires only two magnets and it can be the most simple and useful. In addition, extremely great negative stiffness can be obtained easily since the stationary magnet 104 can be made bigger. Moreover, the characteristic curves of displacement-force of generated negative stiffness are relatively linear.

In FIG. 1 of the first embodiment, the movable magnet 103 and the stationary magnet 104 are magnetized in the thickness direction, but they also can be magnetized in the radial direction as shown in FIG. 4. It is also possible to attach an iron plate, a yoke or the like to the stationary magnet 104 or to the movable magnet 103. Though the movable magnet 103 and the stationary magnet 104 are ring-like in this embodiment, they also can be discs, rectangles, square rings or the like.

Though the movable magnet 103 is attached to the voice coil 101*c* in the first embodiment, the movable magnet 103 can be attached to other parts of the vibration system of the speaker unit 101. It is also possible to provide an elastic material between the movable magnet 103 and the vibration system of the speaker unit 101, as long as the movable magnet 103 and the vibration system move together in a low frequency band.

Though the speaker unit 101 in the first embodiment is a normal electrodynamic type, it can be operated in other electroacoustic conversion methods such as a motor-drive type or an electromagnetic type.

In the first embodiment, the cabinet 102 is an airtight enclosure, but other types of cabinets such as a Kelton type or a bass-reflex type also can be used.

It should be noted that the present invention is not limited to the above-mentioned examples.

(Second Embodiment)

A bass reproduction speaker apparatus in the second embodiment has a configuration identical to the first embodiment shown in FIG. 1. The effects of the equivalent increase in the cabinet internal volume and the improvement in the bass reproduction performance are also the same. The speaker apparatus of the second embodiment is distinguishable only in the dimension of the stationary magnet and the characteristic curves of displacement-force of generated negative stiffness. Therefore, only the stationary magnet 104 and the characteristic curves of displacement-force of negative stiffness are explained specifically here, and the rest will be omitted.

In the second embodiment, the stationary magnet 104 is 65 mm in outer diameter, 32 mm in inner diameter, 10 mm in thickness and it is made of ferrite.

Figure 5:
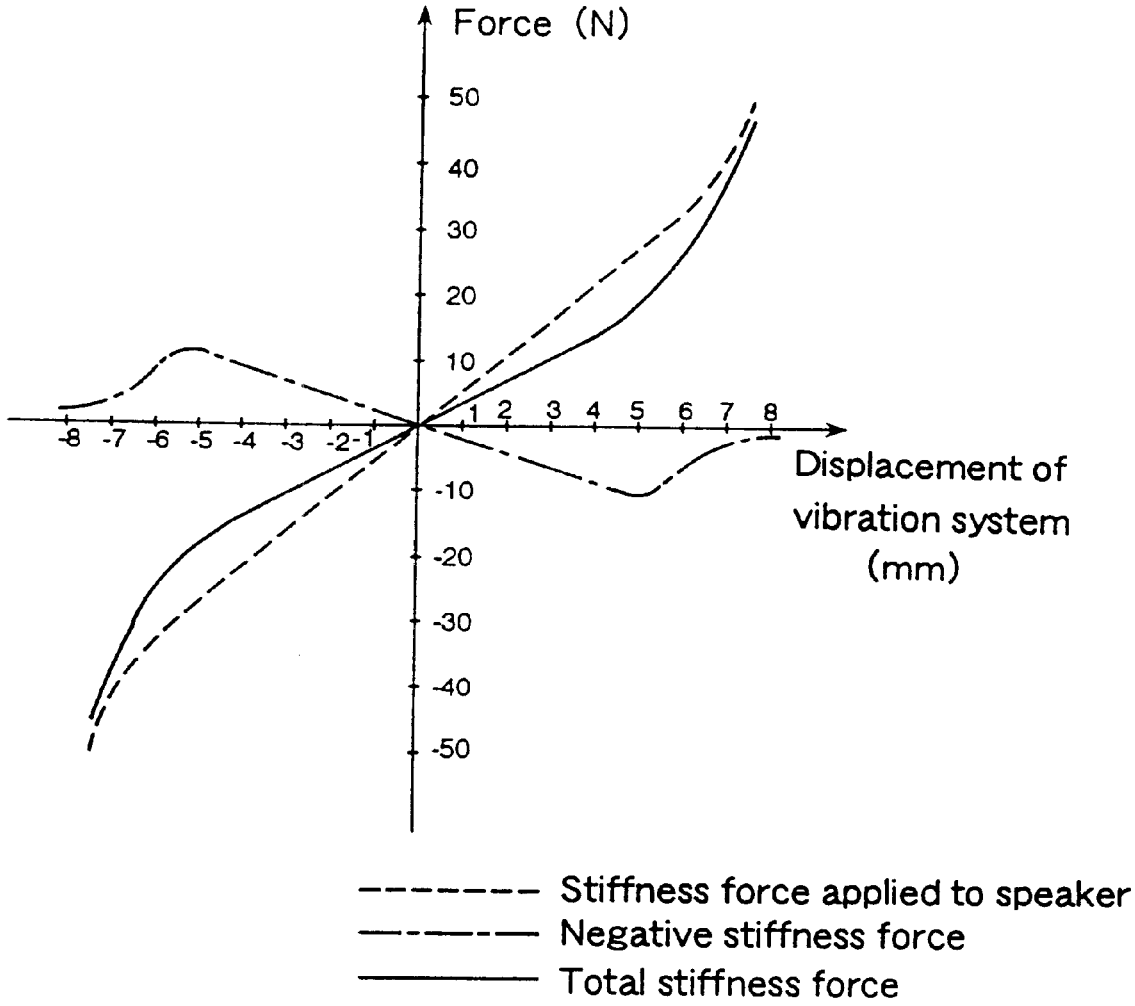
FIG. 5 is a graph including characteristic curves of vibration system displacement-stiffness force of a bass reproduction speaker apparatus in a second embodiment of the present invention.

FIG. 5 is a graph of curves including a characteristic curve of displacement-force of negative stiffness in the second embodiment. In FIG. 5, the broken line indicates a characteristic curve of stiffness force applied to the vibration system of the speaker unit 101 attached to the cabinet 102 to displacement of vibration system. In other words, the broken line is a characteristic curve of displacement-force of the total of the stiffness provided by the supporting system of the speaker unit 101 and by the air in the cabinet 102. The maximum amplitude of the speaker unit 101 is about ±8 mm, and the supporting system stiffens (tension) when the displacement becomes almost 8 mm. Thus, the displacement-force characteristic curve is further inclined around ±8 mm in the graph.

The dashed line in FIG. 5 indicates a characteristic curve of the displacement-force of generated negative stiffness. The gradient of the linear part of the curve is 8 (N)/5 (mm), i.e., 1600 (N/m), which is identical to the calculation value described in the first embodiment. Though the stationary magnet 104 is smaller in the outer diameter than described in the first embodiment, the same level of negative stiffness was generated. An experimental result shows that greater negative stiffness is generated when the stationary magnet has a large outer diameter, but a thinner stationary magnet tend to generate more negative stiffness in this configuration.

In FIG. 5, the characteristic curve of the dashed line indicating the displacement-force of negative stiffness reaches to its peak around ±5 mm, and the stiffness force is decreased beyond ±5 mm. This figure corresponds to the half value of the thickness of the stationary magnet 104, so that displacement at the peak is determined in a substantial proportion to the thickness of the stationary magnet 104.

The solid line in FIG. 5 indicates the characteristic curve of the displacement-force of stiffness acting on the vibration system of the speaker unit 101 as the total stiffness when the negative stiffness is generated. The curve shows that the stiffness is increased beyond around ±5 mm. In other words, the movable magnet 103 and the stationary magnet 104 are configured so that the generated negative stiffness is decreased before the displacement of the vibration system of the speaker unit 101 reaches its maximum. As a result, stiffness can be increased from a range with less displacement compared to the maximum displacement of the vibration system of the speaker unit 101.

Since the vibration system of the speaker unit 101 is braked before it reaches its maximum amplitude, the supporting system is not subject to abrupt stiffness (tension) when excessive input is added to the speaker unit 101. As a result, a bass reproduction speaker apparatus resistant to excessive input can be provided.

It should be noted that the present invention is not limited to the above-mentioned examples.

(Third Embodiment)

A bass reproduction speaker apparatus in the third embodiment of the present invention is explained below by referring to FIG. 6.

A speaker unit 131 (131*a*–131*g*) and a cabinet 132 in the third embodiment correspond respectively to the speaker unit 101 (101*a*–101*g*) and the cabinet 102 in the first embodiment shown in FIG. 1. As the components in the third embodiment are identical to those in the first embodiment, further explanation will be omitted.

In the third embodiment, a movable magnet 133 is 28 mm in outer diameter, 20 mm in inner diameter and 3 mm in thickness, and it is made of intense neodymium whose magnetic energy product is 45M·G·0e (megagauss oersted). A stationary magnet 134 is 75 mm in outer diameter, 32 mm in inner diameter, and 15 mm in thickness, and it is made of ferrite. The movable magnet 133 and the stationary magnet 134 are magnetized with homopolarity in the thickness direction and the magnets repel each other. As a result, negative stiffness generated in the third embodiment is 2800 (N/m) and considerably exceeds stiffness of the supporting system (2130 (N/m)) of the speaker unit 131.

The third embodiment further includes detectors (135, 135*a*) to detect an offset in the displacement direction of the vibration system of the speaker unit 131 and to generate an electric signal. Accordingly, an offset in the displacement direction of the vibration system of the speaker unit 131 is corrected by feeding back the electric signal from the detectors to a power amplifier 136 driving the speaker unit 131.

More specifically, 135 denotes a Hall element, which is arranged vertically in the vicinity of the center of the movable magnet 133 in the thickness direction. Numeral 135*a* denotes a feedback circuit to feed back an output signal from the Hall element to the power amplifier 136.

The Hall element 135 generates an output signal according to a magnetic flux vector that the movable magnet 133 generates horizontally inward. The horizontal magnetic flux vector becomes zero at the central position in the thickness direction between the N pole and S pole of the movable magnet 133. As a result, no signals will be outputted when the central position in the thickness direction of the movable magnet 133 and the central position in the vertical direction of the Hall element 135 are correspondent with each other, since the magnetic flux horizontally passing the Hall element 135 becomes zero.

When the movable magnet 133 is displaced to either side, the magnetic flux distribution becomes asymmetrical at the position of the Hall element 135 (i.e., either the N pole side or the S pole side approaches the Hall element 135), and a magnetic flux vector in the horizontal direction is generated. At this time, a signal is generated from the Hall element 135. Obviously, if the Hall element 135 generates a plus signal at the approaching of the N pole side, the same Hall element 135 generates a minus signal when the S pole side approaches, since the direction of the magnetic flux vector is inverted.

When the vibration system of the speaker unit 131 has no offsets in the displacement direction, an electric signal that the Hall element 135 generates at an addition of bass ac power to the speaker unit 131 includes a plus side signal and a minus side signal that are symmetric about the zero level, and the signal becomes zero upon integration. However, when the vibration system is offset, the level of either a signal of plus or minus side will be raised (i.e., biased), and thus, a signal will be generated even when integration is carried out.

In the third embodiment, therefore, the Hall element 135 and the feedback circuit 135*a* are configured so that a current is outputted from the power amplifier 136 to the speaker unit 131 in the direction to reverse the direction of displacement of the vibration system of the speaker unit 131 when the vibration system begins to be offset to one direction. In other words, the current is outputted to bring the vibration system back to its inherent displacement central position.

Figure 7:
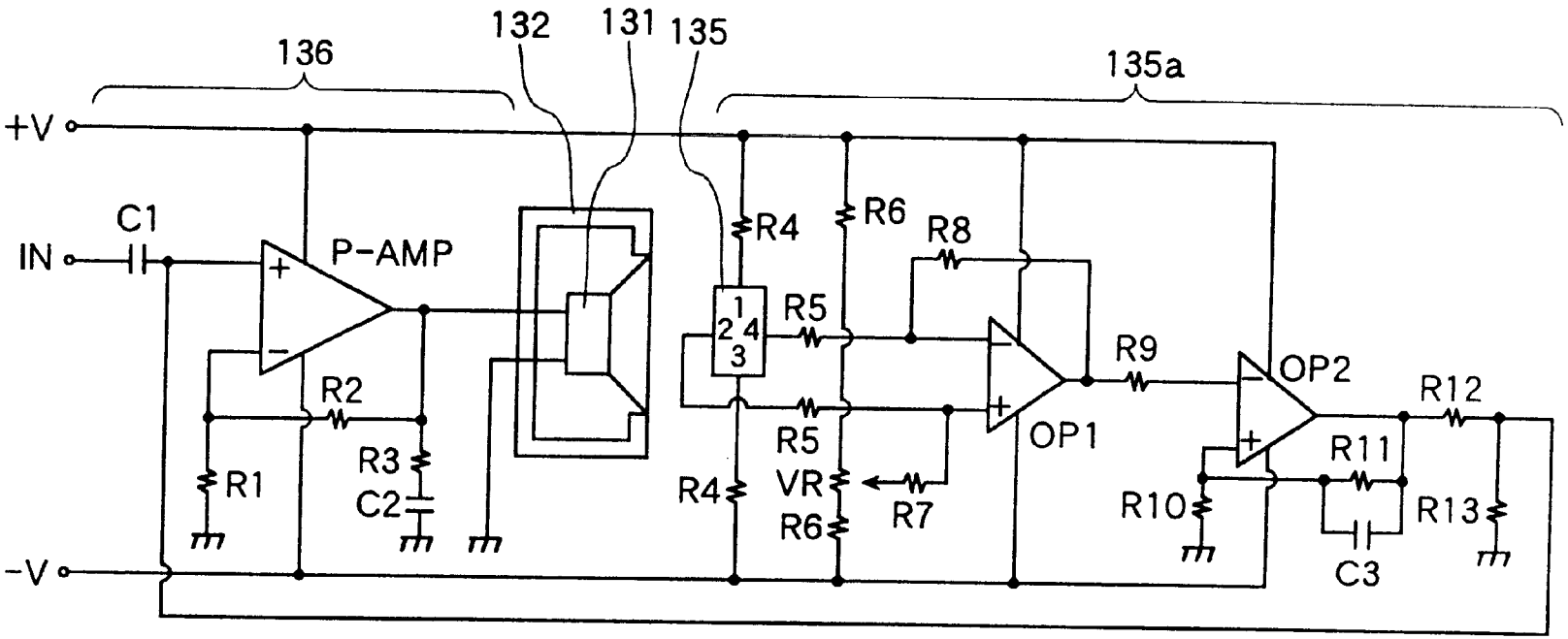
FIG. 7 is a diagram of a return circuit including a detector in the third embodiment.

FIG. 7 shows a circuit diagram of the feedback circuit 135*a* including the detector 135, the feedback circuit 135*a*, and the power amplifier 136. In FIG. 7, terminals 1 and 3 of the Hall element 135 are used to supply a current for driving, while terminals 2 and 4 are output terminals. Detection voltage is generated at the both ends. OP1 denotes an op-amp of a buffer amplifier and OP2 denotes an op-amp of an integrating circuit. P-AMP denotes a typical audio IC power amplifier with an output of 30W.

C3 denotes an integrating capacitor, and the amplification gain of the OP2 is damped as the frequency rises. As a result, only an ultra-low frequency component signal corresponding to the moving offset of the vibration system of the speaker unit 131 is fed back. No feedback will be applied to the motion of the vibration system at a bass range of at least tens of Hz in an audio source of music etc., so the bass will not be affected. VR denotes a volume for offset adjustment, and it can adjust the output voltage of the feedback circuit (e.g., making the voltage to be zero) when the vibration system of the speaker unit 131 is located at the inherent central position.

The P-AMP portion to be connected with the feedback circuit 135*a* has a DC amplifier configuration so that the speaker 131 is supplied with an electric current corresponding to the ultra-low frequency component signal fed back from the feedback circuit 135*a* to the plus terminal of the P-AMP (i.e., power to correct an offset in the displacement direction of the vibration system).

However, a capacitor C1 to break a direct current is inserted between a terminal IN for receiving a source signal and the P-AMP, so that the entire power amplifier 136 operates as a typical audio power amplifier. In other words, the power amplifier alone can supply the speaker unit 131 with power including both the source signal power of the audio and the power to correct the offset in the displacement direction of the vibration system.

Accordingly, the speaker unit 131 is servoed to constantly correct even a slight offset in the displacement direction of the vibration system and to hold the vibration system in the inherent displacement central position. As a result, extremely stable operation can be provided even if the negative stiffness is great, since the average displacement central position of the vibration system is held at the inherent central position.

Therefore, due to the detection and feedback, the bass reproduction speaker apparatus in the third embodiment operates stably even when the generated negative stiffness is greater than the stiffness of the supporting system of the speaker unit 131. The internal volume of the cabinet 132 is increased equivalently to 6.8 times, and the fundamental resonance frequency, i.e., the bass reproduction limit frequency is extended vastly from 96 Hz to 67 Hz.

As mentioned above, the third embodiment can provide a bass reproduction speaker apparatus in which the equivalent internal volume of a cabinet is increased significantly in a large scale and the bass reproduction performance is excellent. Moreover, the detector can have a simple configuration since the detector in this embodiment is a Hall element 135.

The detector is not limited to the Hall element 135 in the third embodiment, but other methods such as an optical method using a CDS (cadmium cell), a photo diode, a photo transistor or the like also can be used. The feedback circuit can be omitted by replacing the Hall element 135 with a Hall IC.

The Hall element 135 is used to detect magnetic flux of the movable magnet 133 in this embodiment, but it is also possible to detect magnetic flux of a small magnet other than the movable magnet 133 attached to the vibration system.

It should be noted that the present invention is not limited to the above-mentioned examples.

(Fourth Embodiment)

Figure 8:
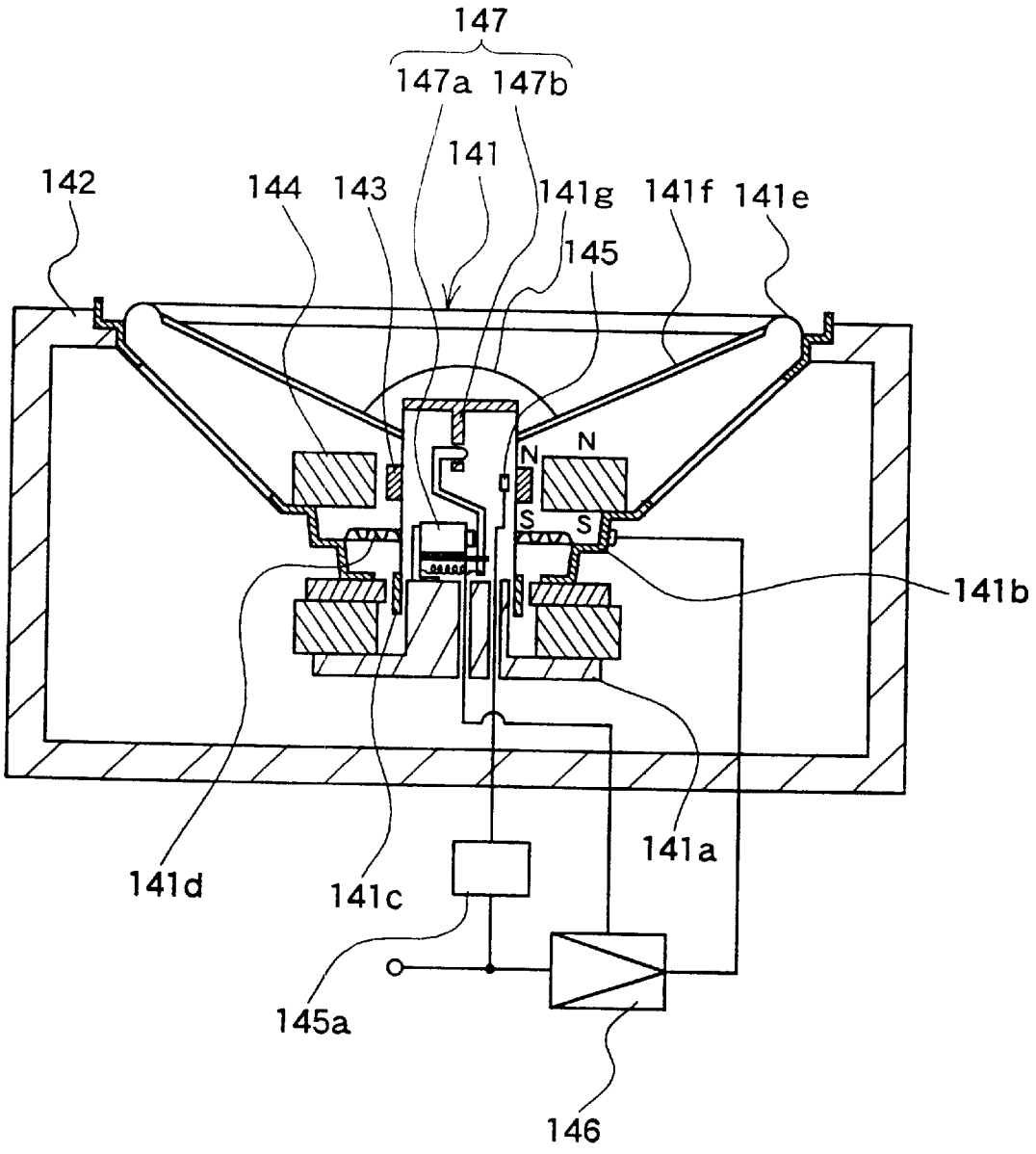
FIG. 8 is a cross-sectional view to show a configuration of a bass reproduction speaker apparatus in a fourth embodiment of the present invention.

A bass reproduction speaker apparatus in the fourth embodiment of the present invention is explained below referring to FIG. 8.

Figure 6:
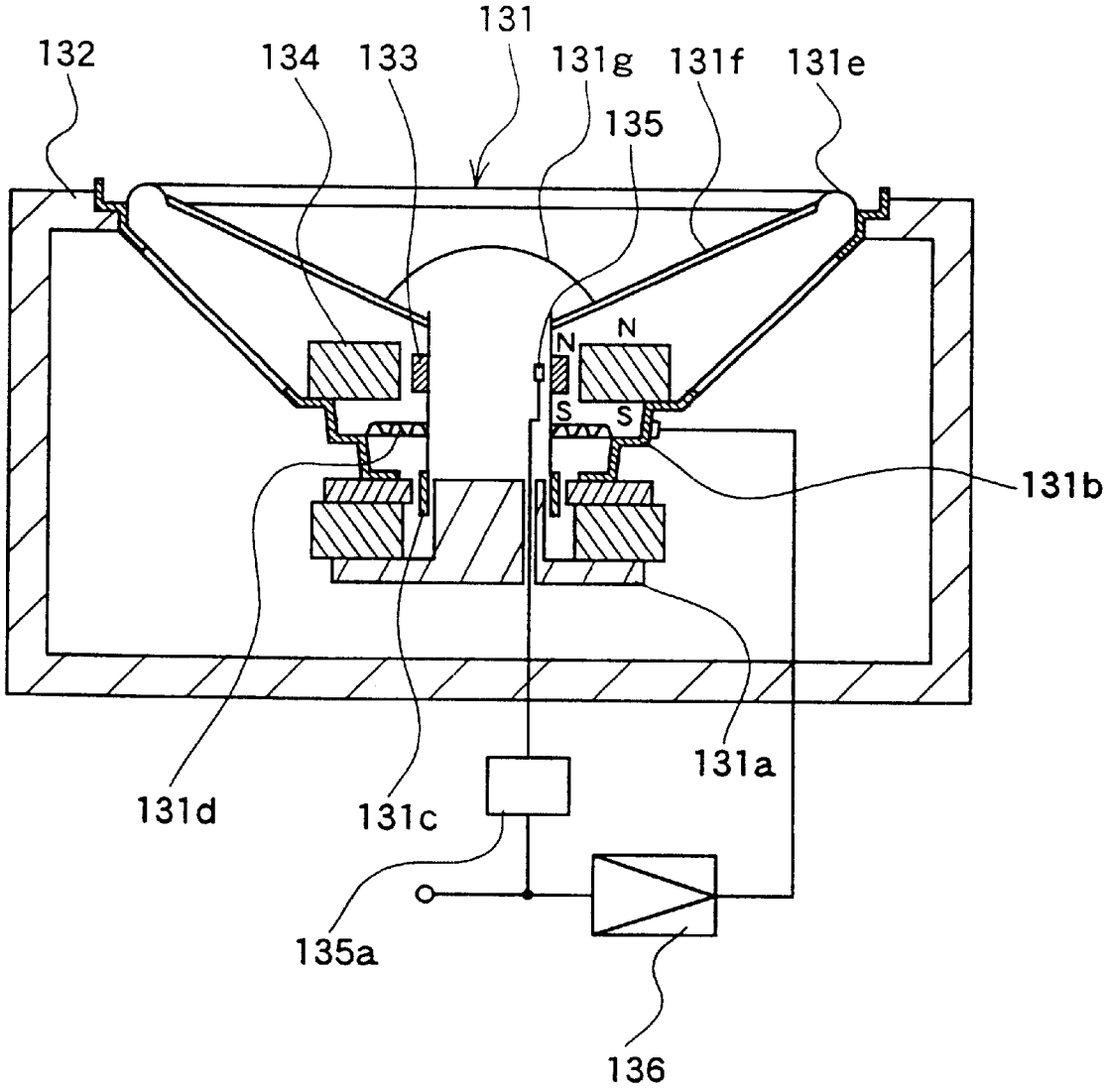
FIG. 6 is a cross-sectional view to show a configuration of a bass reproduction speaker apparatus in a third embodiment of the present invention.

A speaker unit 141 (141*a*–141*g*), a cabinet 142, a movable magnet 143, a stationary magnet 144, a Hall element 145 as a detector and a feedback circuit 145*a* in the fourth embodiment correspond respectively to the speaker unit 131 (131*a*–131*g*), the cabinet 132, the movable magnet 133, the stationary magnet 134, the Hall element 135 (detector) and the feedback circuit 135*a* in the third embodiment shown in FIGS. 6 and 7. As the components in the fourth embodiment are identical to those in the third embodiment, further explanation will be omitted.

The fourth embodiment provides a configuration including a holder 147 to hold the vibration system of the speaker unit 141 around the central position in the displacement direction (vibration system holder) when the bass reproduction speaker apparatus does not operate, i.e., when a power source of the power amplifier 146 is turned off.

More specifically, 147*a* denotes a plunger, and it is supplied with power by using the power amplifier 146 for driving the speaker unit 141 in the fourth embodiment. Numeral 147*b* denotes a rod attached to the voice coil 141*c* of the speaker unit 141, and the rod is made of resin.

The rod 147*b* is formed with an aperture to fit an arm of the plunger 147*a* in order to lock the rod 147*b* when the plunger 147*a* is not energized. While the plunger 147*a* is energized, the arm instantly is attracted and removed from the rod 147*b*.

In the fourth embodiment, therefore, the vibration system of the speaker unit 141 is held around the central position in the displacement direction when the bass reproduction speaker apparatus does not operate, and thus, the vibration system is prevented from being offset to one side over a long time. As a result, stress applied to an edge 141*e* or to a damper 141*d* can be reduced, and a long-life bass reproduction speaker apparatus with less change over time can be provided.

It should be noted that the present invention is not limited to the above-mentioned examples.

(Fifth Embodiment)

In a bass reproduction speaker apparatus in the fifth embodiment, an electromagnet is used for the stationary magnet in the aforementioned embodiments. Accordingly, the generated negative stiffness can be adjusted by increasing or decreasing a current running through the electromagnet, and thus, the fundamental resonance frequency of the bass reproduction speaker apparatus can be varied. Moreover, the stationary electromagnet can be turned off when the bass reproduction speaker apparatus does not operate, and generation of negative stiffness also can be stopped when the bass reproduction speaker apparatus does not operate. As a result, the fifth embodiment can also provide a long-life bass reproduction speaker apparatus with less change over time.

The stationary electromagnet can be a superconductive magnet.

It should be noted that the present invention is not limited to the above-mentioned examples.

(Sixth Embodiment)

Figure 9A:
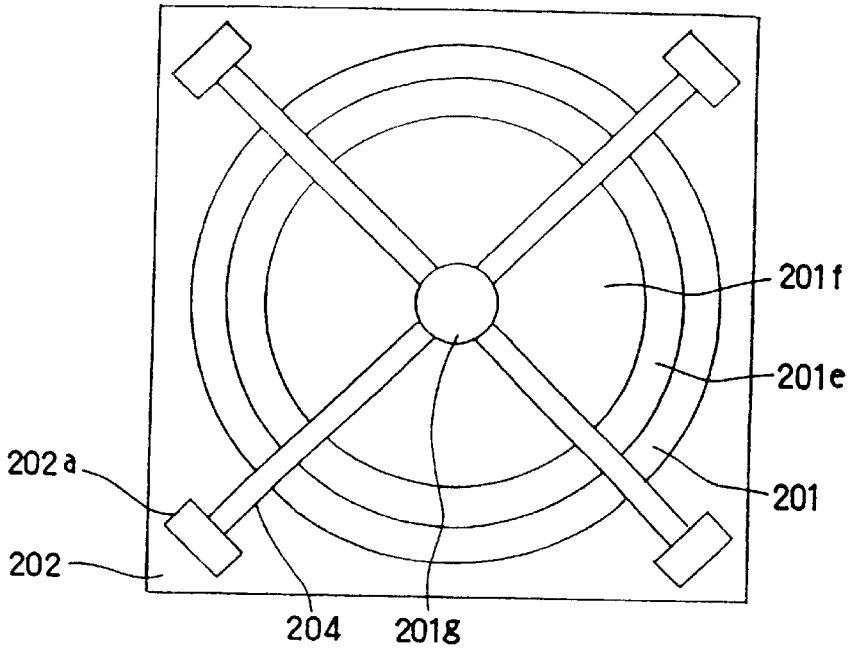
Figure 9B:
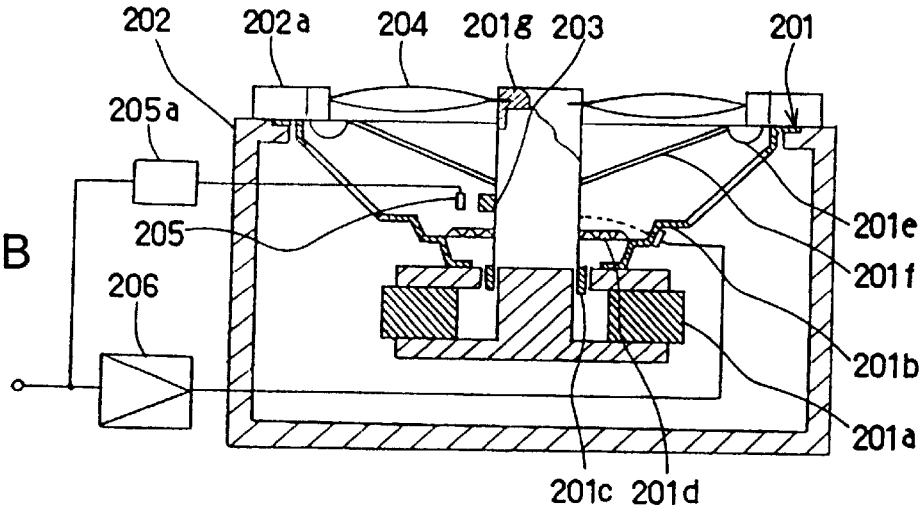

FIGS. 9A and 9B show a configuration of a bass reproduction speaker apparatus in the sixth embodiment. In FIGS. 9A and 9B, a speaker unit 201, including a field magnetic portion 201*a*, a frame 201*b*, a voice coil 201*c*, a damper 201*d*, an edge 201*e*, a diaphragm 201*f* and a movable part supporting member 201*g* doubling as a dust cap, is attached to an airtight cabinet 202. A movable magnet 203 is attached to a bobbin of the voice coil 201*c* and the movable magnet 203 moves together with a vibration system including the voice coil 201*c* and a diaphragm 201*f* of the speaker unit 201.

The movable part supporting member 201*g* is attached to the tip of the extended bobbin of the voice coil 201*c*. Stationary part supporting members 202*a* are fixed at four positions outwards the frame 201*b* of the cabinet 202 symmetrically about the central axis. A pair of springs 204 composed of opposed warped plate springs are attached between each stationary part supporting member 202*a* and the movable part supporting member 201*g*, and the springs 204 are compressed from the both ends. That is, the springs 204 provide repulsion to the movable part supporting member 201*g* and to the stationary part supporting member 202*a*, and thus, the springs 204 provide negative stiffness to the movable part supporting member 201, i.e., to the vibration system of the speaker unit 201 based on the same principle of the aforementioned conventional techniques.

The four sets of springs 204 are identical, and they are attached at symmetrical positions. Therefore, the repulsion is well-balanced in the horizontal direction and the movable part supporting member 201*g* is kept at the center in the horizontal direction.

In the vicinity of the movable magnet 203, a Hall element 205 is arranged as a detector to generate an electric signal according to displacement of the vibration system. The speaker unit 201 is driven by a power amplifier 206 for reproducing a source signal. An output signal of the Hall element 205 is fed back to the power amplifier 206 through the feedback circuit 205*a*, and power to correct an offset in the displacement direction of the vibration system of the speaker unit 201 is added to the source signal power, and supplied from the power amplifier 206 to the voice coil 201*c*.

The materials, dimensions, performance and circuit configurations of the bass reproduction speaker apparatus are specifically explained below.

The caliber of the speaker unit 201 is 18 cm. The field magnetic portion 201*a* is made of ferrite magnet 70 mm in diameter. The frame 201*b* is 18 cm in caliber and it is made of a steel plate. The voice coil 201*c* has a caliber (nominal diameter) of 25 mm. The edge 201*e* made of urethane foam has a down-roll shape. The diaphragm 201*f* is a paper cone. The movable part supporting member 201*g* is made of resin.

The cabinet 202 is a small airtight enclosure with an internal volume of 10 liters. The stationary part supporting member 202*a* is made of resin. The springs 204 including pairs of warped plate springs are 10 cm in length when they are attached. The springs 204 are 1 cm in width and they are made of phosphor bronze plates.

The following is a detailed explanation of the principle of equivalent increase in cabinet internal volume due to the negative stiffness and also improvement in the bass reproduction performance.

When the effective vibration mass of the speaker unit is M and the fundamental resonance frequency in a single free-air state is f0, the stiffness Ks of the supporting system (e.g., the damper and the edge) of the speaker unit is represented as follows:

$$Ks=M\times(2\pi f0)^2. \qquad \text{Equation 1}$$

When the effective vibration radius of the speaker unit is a, the air acoustic velocity is c, the air density is ρ, and the cabinet internal volume is V, stiffness Kc provided by air in the cabinet to the vibration system of the speaker unit is represented by $$Kc=\rho c^2(\pi a)^2/V. \qquad \text{Equation 2}$$

While the speaker unit is attached to a cabinet, the vibration system of the speaker unit is subjected to stiffness of Ks+Kc. When the fundamental resonance frequency at this time is f1, the relationship is represented as follows:

$$f1=(Ks+Kc)^{1/2}/2\pi M^{1/2}. \qquad \text{Equation 3}$$

When the level of the negative stiffness is determined to be Kn, the stiffness acting on the vibration system of the speaker unit is Ks+Kc−Kn. This means that the air stiffness in the cabinet converts from Kc to Kc−Kn. The air stiffness in the cabinet is inversely proportional to the internal volume as given by Equation 2. Therefore, this is equivalent to an increase of the cabinet internal volume from 1/Kc to 1/(Kc−Kn).

Since the negative stiffness acts, the fundamental resonance frequency of the speaker unit attached to the cabinet will be represented as follows:

$$f1=(Ks+Kc-Kn)^{1/2}/2\pi M^{1/2}. \qquad \text{Equation 4}$$

Therefore, the fundamental resonance frequency is lowered by $\{(Ks+Kc-Kn)/(Ks+Kc)\}^{1/2}$ times, namely, the bass reproduction limit frequency is extended in this range and the bass reproduction performance is improved.

If the technique of the negative stiffness is not used, the effective vibration mass should be increased or the effective vibration area should be decreased to lower the fundamental resonance frequency, and this will lower the efficiency. Negative stiffness can lower the fundamental resonance frequency without changing the effective vibration mass or area, so the bass can be extended without lowering the efficiency.

The effects of the equivalent increase in the cabinet internal volume in this embodiment and improvement in the bass reproduction performance will be explained here with calculations following the above-mentioned principle.

In this embodiment, the fundamental resonance frequency of the speaker unit 201 is 60 Hz and the effective vibration mass is 15 g, when the compression on the springs 204 is loosened not to generate negative stiffness. The effective vibration radius is 70 mm. That is, the supporting system stiffness Ks of the speaker unit is 2130 (N/m) given by the Equation 1. The stiffness Kc provided by the air in the cabinet 202 is 3290 (N/m) given by the Equation 2. That is, Ks+Kc=5420 (N/m). When the speaker unit 201 is attached to the cabinet 202, the fundamental resonance frequency f1 of the speaker unit 201 is 96 Hz given by the Equation 3, and it is identical to the measured value.

Negative stiffness Kn is 2800 (N/m) when the springs 204 are attached in a compressed state, and the value exceeds the stiffness (Ks=2130 (N/m)) of the supporting system of the speaker unit 201. The total stiffness is Ks+Kc−Kn=5420−2800=2620 (N/m). This indicates that the fundamental resonance frequency (bass reproduction limit frequency) in the sixth embodiment is extended remarkably from 96 Hz to 67 Hz.

This is equivalent to the internal volume in the cabinet 202 increasing in proportion from 1/3290 to 1/(3290−2800)=1/490. In other words, the internal volume of the cabinet 202 is increased substantially by several times in this embodiment.

Next, a configuration to correct an offset in the displacement direction of the vibration system of the speaker unit 201 is explained in detail.

The dimensions of the movable magnet 203 are 5 mm×5 mm and 3 mm in thickness, and it is made of ferrite. The movable magnet 203 is magnetized in the perpendicular direction, namely, the vertical direction in FIG. 9B, in which the upper part is N pole and the lower part is S pole. The Hall element 205 is arranged vertically in the vicinity of the perpendicular center of the movable magnet 203. The two components are separated by about 3 mm.

The Hall element 205 generates an output signal according to a magnetic flux vector generated horizontally by the movable magnet 203. The horizontal magnetic flux vector becomes zero at the perpendicular central position of the movable magnet 203, since the magnet flux passes vertically from the N pole to the S pole. As a result, no signals will be outputted when the perpendicular central position of the movable magnet 203 and the perpendicular central position of the Hall element 205 are correspondent with each other, since the magnetic flux horizontally passing the Hall element 205 becomes zero.

When the movable magnet 203 is displaced to either side, the magnetic flux distribution becomes asymmetrical at the position of the Hall element 205 (i.e., either the N pole side or the S pole side of the movable magnet 203 approaches the Hall element 205), and a magnetic flux vector in the horizontal direction is generated. At this time, a signal is generated from the Hall element 205. Obviously, if the Hall element 205 generates a plus signal at the approaching of the N pole side, the same Hall element 205 generates a minus signal when the S pole side approaches, since the direction of the magnetic flux vector is inverted. Accordingly, an electric signal corresponding to displacement of the vibration system of the speaker unit 201 is obtained.

When the average vibration displacement center of the vibration system of the speaker unit 201 is at its inherent central position, i.e., when the vibration system of the speaker unit 201 has no offsets in the displacement direction, an electric signal the Hall element 205 generates at an addition of bass ac power to the speaker unit 201 includes a plus side signal and a minus side signal that are symmetric with respect to the zero level, and the signal becomes zero upon integration. However, when the vibration system is offset in the displacement direction, either the signal of the plus or minus side will be increased (i.e., biased), and thus, a signal will be generated even when integration is carried out.

In the sixth embodiment, therefore, the Hall element 205 and the feedback circuit 205*a* are configured so that a current is outputted from the power amplifier 206 to the speaker unit 201 in the direction to reverse the direction of displacement of the vibration system of the speaker unit 201 when the vibration system begins to be offset in one direction. In other words, the current is outputted to bring the vibration system back to its inherent displacement central position.

Figure 10:
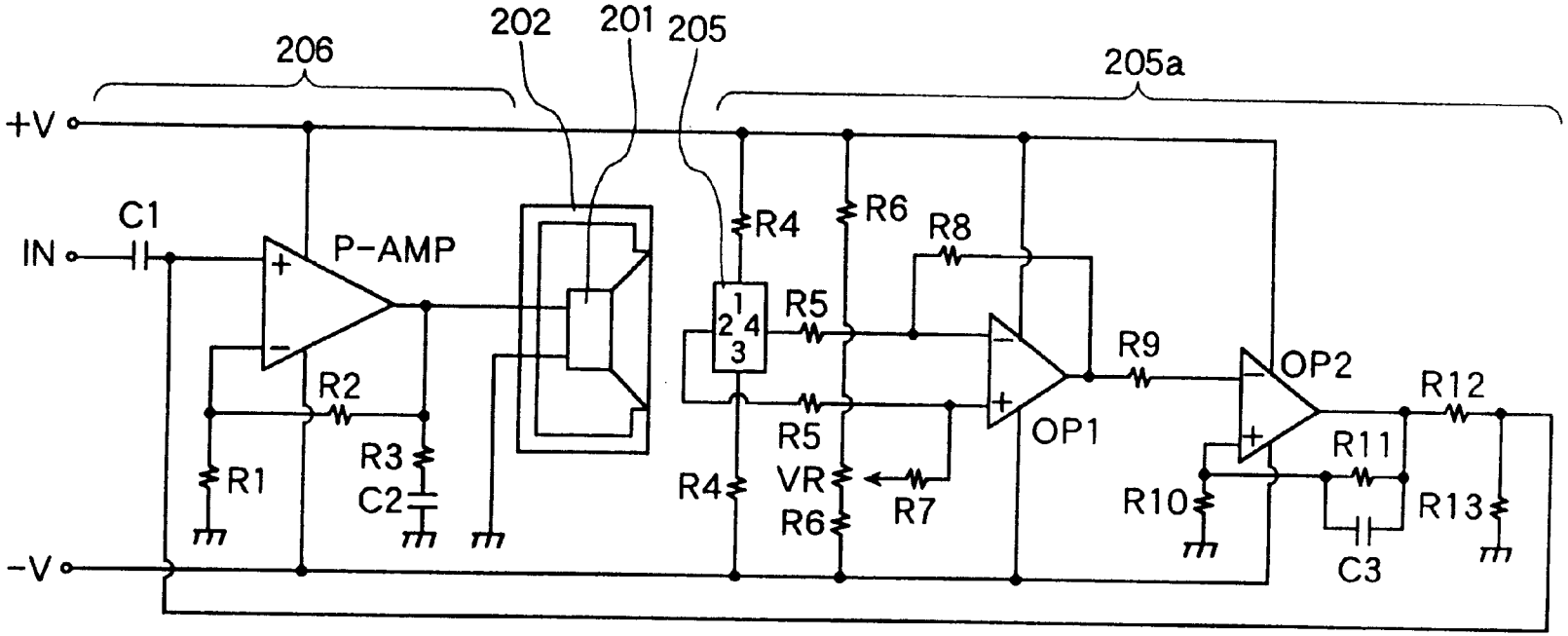
FIG. 10 is a diagram to exemplify a feedback circuit in the sixth embodiment of the present invention.

FIG. 10 shows a circuit diagram of the feedback circuit 205*a* including the detector 205, the feedback circuit 205*a*, and also the power amplifier 206. In FIG. 10, terminals 1 and 3 of the Hall element 205 are used to supply a current for driving, while terminals 2 and 4 are output terminals. A detection voltage is generated at the both ends. OP1 denotes an op-amp of a buffer amplifier and OP2 denotes an op-amp of an integrating circuit. P-AMP denotes a typical audio IC power amplifier with an output of 30W.

C3 denotes an integrating capacitor, and the amplification gain of the OP2 is damped as the frequency rises. As a result, only an ultra-low frequency component signal corresponding to the moving offset of the vibration system of the speaker unit 201 is fed back. No feedback will be applied to the motion of the vibration system at the bass range of at least tens of Hz in an audio source of music etc., so the bass will not be affected. VR denotes a volume for offset adjustment, and it can adjust the output voltage of the feedback circuit (e.g., making the voltage to be zero) when the vibration system of the speaker unit 201 is located at the inherent central position.

The P-AMP portion to be connected with the feedback circuit 205*a* has a DC amplifier configuration so that the speaker 201 is supplied with an electric current corresponding to the ultra-low frequency component signal fed back from the feedback circuit 205*a* to the plus terminal of the P-AMP (i.e., power to correct the offset in the displacement direction of the vibration system).

However, a capacitor C1 to break a direct current is inserted between a terminal IN for receiving a source signal and the P-AMP, so that the entire power amplifier 206 operates as a typical audio power amplifier. In other words, the power amplifier 206 alone can supply the speaker unit 201 with power including both the source signal power of the audio and the power to correct the offset in the displacement direction of the vibration system.

Accordingly, the speaker unit 201 is servoed to constantly correct even a slight offset in the displacement direction of the vibration system and to hold the vibration system at the inherent displacement central position. As a result, an extremely stable operation can be provided since the average displacement central position of the vibration system is held at the inherent central position even if the negative stiffness is great.

In this embodiment, there is no need to provide additional intake-exhaust pumps or power amplifiers for control to correct an offset in the displacement direction of the vibration system, unlike the conventional techniques. Moreover, the voice coil 201*c* of the speaker unit 201*c* is not required to be made a double voice coil. The detector 205 and the feedback circuit 205*a* can be configured in a simple manner, and all of the components are inexpensive.

Figure 18A:
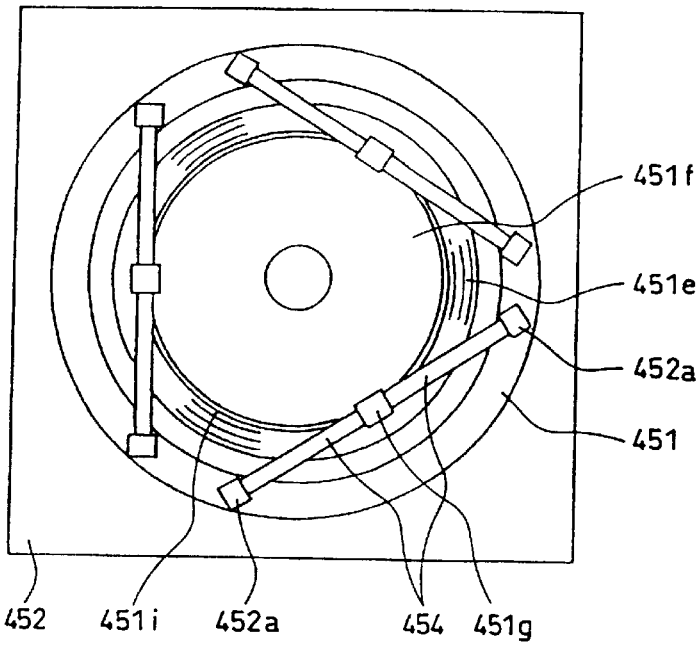
FIG.18A PRIOR ART
Figure 18B:
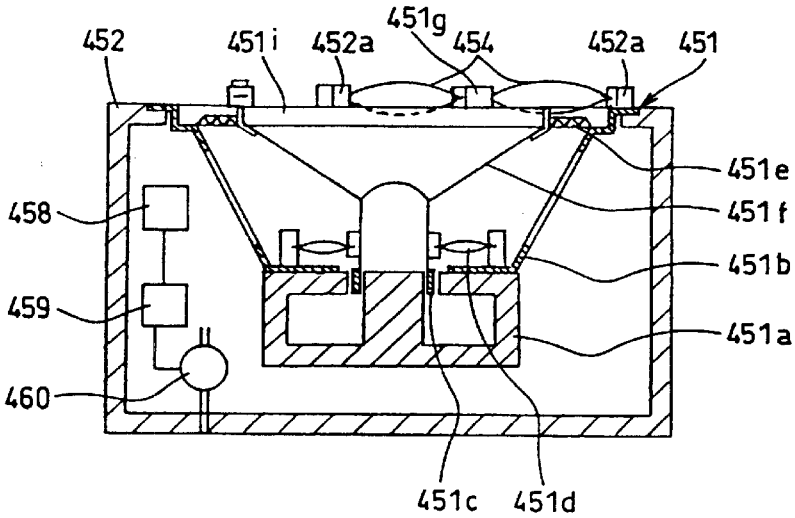
FIG.18B PRIOR ART
Figure 19A:
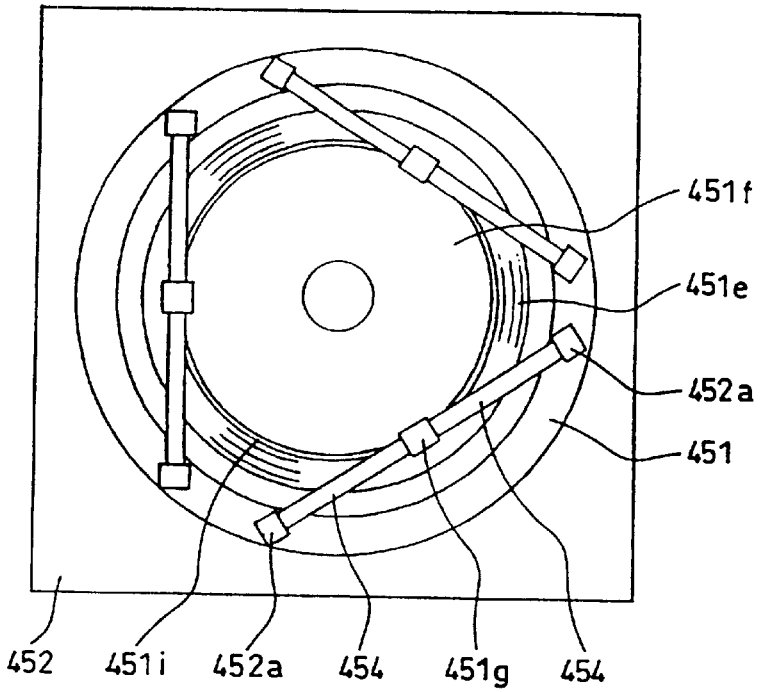
FIG.19A PRIOR ART
Figure 19B:
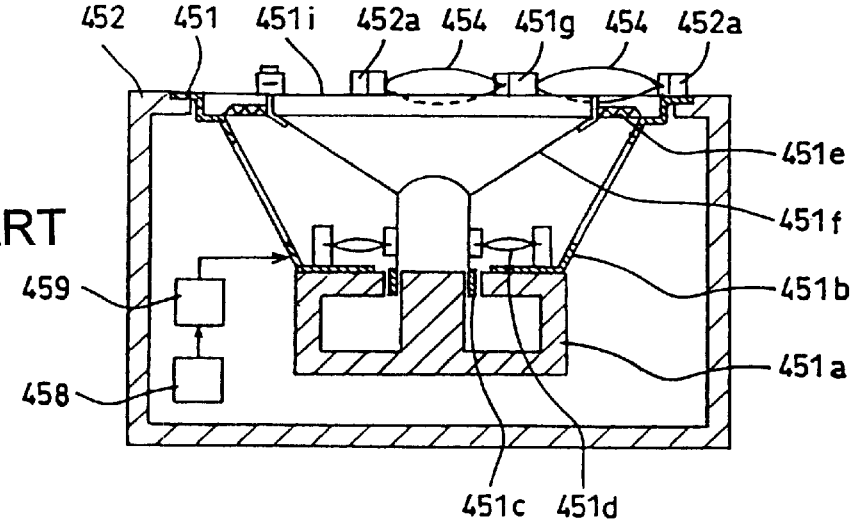
FIG.19B PRIOR ART
Figure 20:
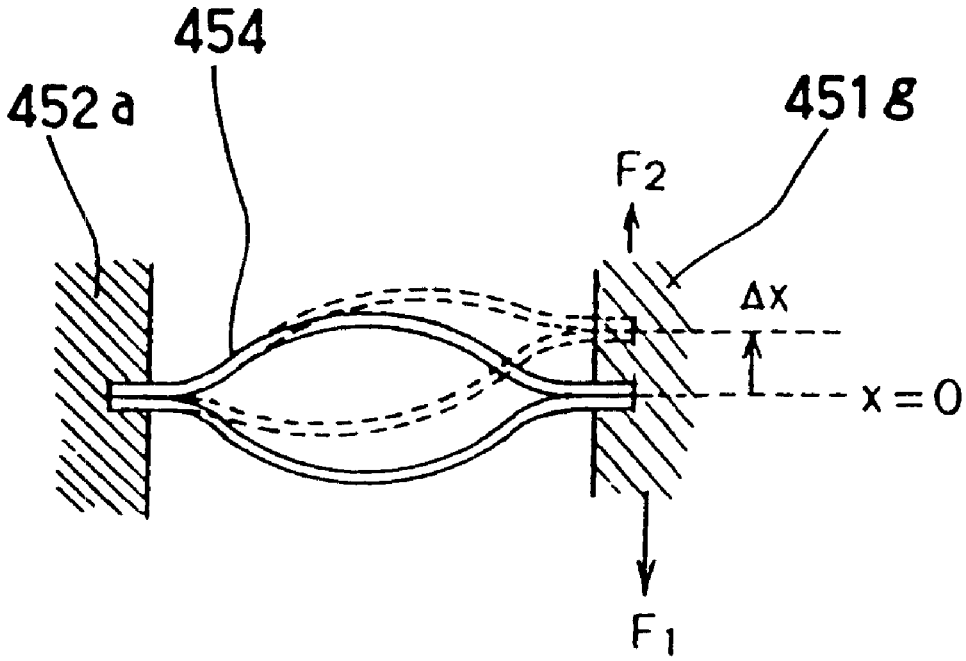
FIG. 20 PRIOR ART
FIG. 20 is an explanatory view to show an operation of conventional springs to provide negative stiffness.
Figure 21:
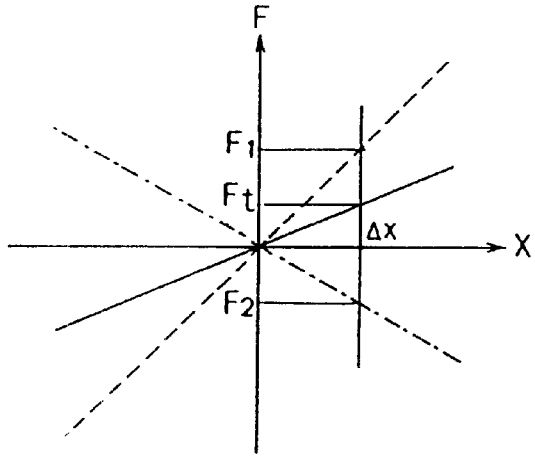
FIG. 21 PRIOR ART
FIG. 21 is a graph including characteristic curves of vibration system displacement-stiffness force in the conventional technique.

In the conventional apparatus shown in FIGS. 18A and 18B, the length of the springs 454 to be attached between the movable part supporting member 451*g* and the stationary part supporting member 452*a* is limited to only 5 cm when the caliber of the speaker unit 451 is also 18 cm. On the contrary, the springs 204 in this embodiment are attached between the central position of the vibration system of the speaker unit 201 and the outer radius of the frame 201*b*, i.e., the springs 204 to be attached between the movable part supporting member 201*g* and the stationary part supporting member 202*a* are extended to be 10 cm. Therefore, mechanical fatigue of the springs 204 can be reduced extremely.

Therefore, the sixth embodiment provides a bass reproduction speaker apparatus with a simple configuration at a low cost, and the speaker apparatus is reliable, practical and excellent in the bass reproduction performance.

Though the movable magnet 203 is attached to the voice coil 201*c* in the sixth embodiment, the movable magnet 203 can be attached to other part of the vibration system of the speaker unit 201. It is also possible to provide an elastic material between the movable magnet 203 and the vibration system of the speaker unit 201, as long as the movable magnet 203 and the vibration system move together in a bass range. In this case, the Hall element 205 should not be positioned too close to the field magnetic portion 201*a*, since magnetic flux leaked from the field magnetic portion 201*a* will affect the Hall element 205.

Though the speaker unit 201 in the sixth embodiment is a normal electrodynamic type, it can be operated in other electroacoustic conversion methods such as a motor-drive type or an electromagnetic type.

Negative stiffness is provided by a mechanical means using springs in the sixth embodiment, but the means can be a magnetic means as described in the following seventh embodiment. Electrostatic means using repulsion between homopolar electric charges also can be used.

Four springs 204 are arranged symmetrically about the central axis (i.e., radially) in the sixth embodiment, but the number of the springs can be three or the like. The number of the springs 204 can be reduced to two if the negative stiffness generated by the springs 204 is not required to be so great.

The springs 204 in the sixth embodiment may include warped plate springs made of phosphor bronze, but other materials or shapes can be selected. For example, springs made of a shape memory alloy will have less mechanical fatigue and improved reliability.

The stationary part supporting member 202*a* in the sixth embodiment is fixed to the cabinet 202, but the sufficient length of the springs 204 can be kept even if they are attached to the outer rim of the frame 201*b* of the speaker unit 201.

The cabinet 202 in the sixth embodiment is an airtight enclosure, but other types of cabinets such as a Kelton type can be used as long as the rear side of the speaker unit is enclosed.

The detector used in the sixth embodiment is the Hall element 205, but it is needless to say that some other methods for detection can be used. The methods include, for example, an optical method to detect variation in the light quantity with a CDS, a photo diode, a photo transistor or the like, an electrostatic method to detect capacitance between a movable part electrode attached to a vibration system of a speaker unit and a stationary part electrode, and an inductive method to detect inductance variation of a coil by using an iron plate attached to a vibration system of a speaker unit and a coil arranged in the vicinity thereof.

Though the signal provided from the detector is an electric signal in this embodiment, a light signal also can be used. For example, a light source such as a light emitting diode attached to a vibration system of a speaker unit, and an optical fiber that the light enters is used as a detector. This optical fiber is connected to a feedback circuit, and the light is converted into electricity at the entrance of the feedback circuit. In addition to the above-identified forms, a signal from a detector can be varied such as radio waves (electromagnetic waves) and magnetism.

A detector using a Hall element can be configured in the simplest manner. The reason is as follows. In the optical, electrostatic and inductive methods, two (top and bottom) detecting elements should be arranged to discriminate the perpendicular displacement of the vibration system of the speaker unit 201 from the central position. However, as the movable magnet 203 has two polarities of N pole and S pole in the sixth embodiment, the Hall element 205 generates either a plus or minus electric signal according to the perpendicular displacement motion of the vibration system of the speaker unit 201. In other words, a single detecting element can be used to discriminate the perpendicular displacement motion (top and bottom) of the vibration system of the speaker unit 201.

The detector in the sixth embodiment was the Hall element 205, but it can be replaced by, for example, a Hall IC so that the configuration of the feedback circuit can be simplified.

A signal is fed back electrically from the feedback 205*a* to the power amplifier in the sixth embodiment, but this operation can be carried out through a photocoupler or the like.

The part to receive a signal fed back from the power amplifier 206 is configured to be a DC amplifier in the sixth embodiment, but it can be a non-DC amplifier if DC amplification may cause troubles. For example, a large capacitor can be inserted between a resistance R1 and a ground in a circuit shown in FIG. 10 in order to amplify at an ultra-low frequency without carrying out amplification with a complete direct current.

The feedback circuit 205*a* and the power amplifier 206 can be independent devices separated from the cabinet 202, or they can be attached to inside or to the outer wall of the cabinet 202.

It should be noted that the present invention is not limited to the above-mentioned examples.

(Seventh Embodiment)

Figure 11A:
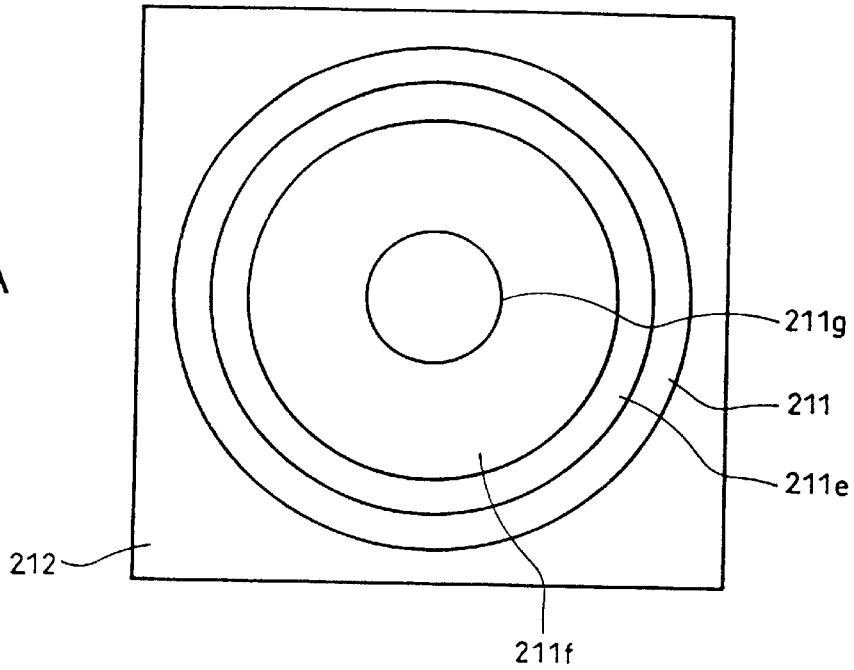
Figure 11B:
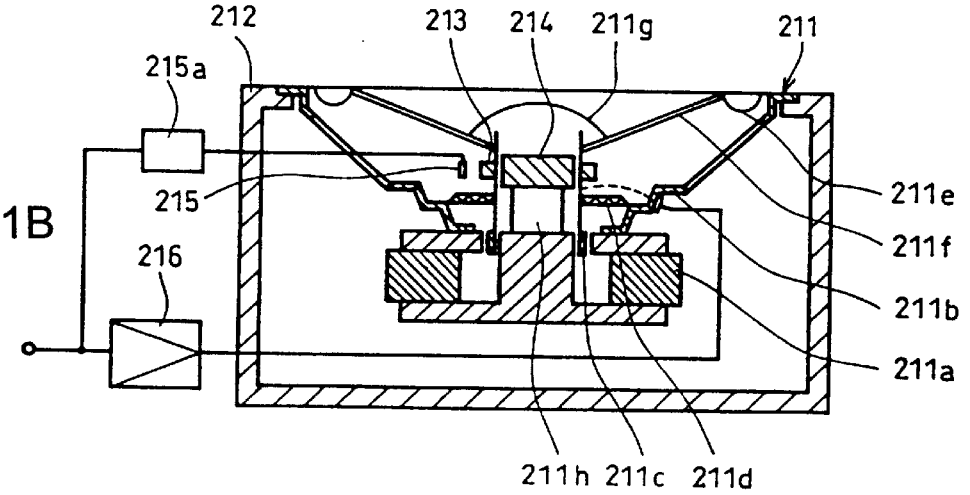

A bass reproduction speaker apparatus in the seventh embodiment of the present invention is explained below referring to FIGS. 11A and 11B.

The bass reproduction speaker apparatus in the seventh embodiment includes a field magnetic portion 211*a*, a frame 211*b*, a damper 211*d*, an edge 211*e*, a diaphragm 211*f*, a cabinet 212, a detector 215, and a power amplifier 216. Since these components correspond respectively to those in the sixth embodiment shown in FIGS. 9A and 9B, i.e., the field magnetic portion 201*a*, the frame 201*b*, the damper 201*d*, the edge 201*e*, the diaphragm 201*f*, the cabinet 202, the detector 205 and the power amplifier 206, and they are identical to each other, further explanation will be omitted.

In this embodiment, the voice coil 211*c* has a caliber of 25 mm as in the sixth embodiment, while the bobbin is not extended but kept in a normal length unlike the aforementioned embodiment. A dust cap 211*g* is attached to the diaphragm 211*f*.

The seventh embodiment is distinguished obviously in that a means to provide negative stiffness to the vibration system of the speaker unit 211 is composed of a movable magnet 213 that moves together with the vibration system of the speaker unit 211, and a stationary magnet 214 that provides repulsion to the movable magnet 213 in the vibration displacement direction of the speaker unit 211.

The movable magnet 213 is ring-like and it is attached to the voice coil 211*c* to move together with the vibration system of the speaker unit 211. The stationary magnet 214 is arranged at the inner radius about a vertical central position common to the movable magnet 213, and the stationary magnet 214 is attached there with a resin supporting member 211*h*. The movable magnet 213 is 30 mm in outer diameter, 25 mm in inner diameter and 3 mm in thickness, and it is made of neodymium whose magnetic energy product is 32M·G·0e (megagauss oersted). The stationary magnet 214 is a cylinder 22 mm in diameter and 10 mm in thickness, and it is made of the same material as the movable magnet 213.

Both the movable magnet 213 and the stationary magnet 214 are magnetized to have upper N poles and lower S poles, and they repel each other. When perpendicular central positions of the movable magnet 213 and of the stationary magnet 214 correspond with each other, no forces are generated in the perpendicular direction, i.e., the direction of displacement of the vibration system of the speaker unit 211.

However, a perpendicular vector occurs in the repulsion force direction when the movable magnet 213 is displaced, and thus, the movable magnet 213 is subject to a force to further push the same magnet in the displacement direction (i.e., negative stiffness). The negative stiffness obtained in the seventh embodiment is substantially the same level as the sixth embodiment.

Similar to the sixth embodiment, the fundamental resonance frequency of the speaker unit 211 is 60 Hz, the effective vibration mass is about 15 g, and the effective vibration radius is 70 mm when the stationary magnet 214 is detached not to provide negative stiffness.

The Hall element 215 as a detector is vertically arranged in the vicinity of the perpendicular center of the movable magnet 213 as in the sixth embodiment. In other words, the movable magnet 213 as a means to generate negative stiffness also is used for detection.

Since the movable magnet 213 in this embodiment is stronger than the movable magnet in the sixth embodiment, the detection voltage level of the Hall element 215 is higher compared to the sixth embodiment. So the gain of the feedback circuit 215*a* is set to be smaller than the sixth embodiment shown in FIG. 10. More specifically, the value of the resistance R8 in FIG. 10 is set to be smaller than the same value in the sixth embodiment, since vibration may occur if the feedback loop gain is too high.

The bass reproduction speaker apparatus thus configured in the seventh embodiment provided similar effects to those described in the sixth embodiment. More specifically, the fundamental resonance frequency (bass reproduction limit frequency) was extended considerably from 96 Hz to approximately 70 Hz by the negative stiffness while correcting the offset in the displacement direction of the vibration system of the speaker unit 211.

Since the negative stiffness is generated without using any mechanical means, no mechanical fatigue will occur. Therefore, a bass reproduction speaker apparatus with higher reliability can be provided.

Therefore, the seventh embodiment provides a bass reproduction speaker apparatus with a simple configuration at a low cost, and the speaker apparatus is reliable, practical and excellent in the bass reproduction performance.

The configuration of the movable magnet 213 and the stationary magnet 214 is not limited to this embodiment, but various configurations can be selected. For example, the stationary magnet 214 can be ring-like and arranged at the outer radius of the movable magnet 213 (in this case, the Hall element 215 can be arranged at the inner radius of the movable magnet 213). Otherwise, an iron plate or a yoke can be attached to the stationary magnet 214 or to the movable magnet 213.

The movable magnet 213 and the stationary magnet 214 are magnetized perpendicularly, i.e., in the direction of the magnet thickness in this embodiment, but the magnets can be magnetized in the radial direction to repel each other.

The Hall element 215 in this embodiment is used to detect magnetic flux of the movable magnet 213 that generates negative stiffness, but a small magnet other than this movable magnet can be attached to the vibration system to detect this magnetic flux.

It should be noted that the present invention is not limited to the above-mentioned examples.

(Eighth Embodiment)

Figure 12A:
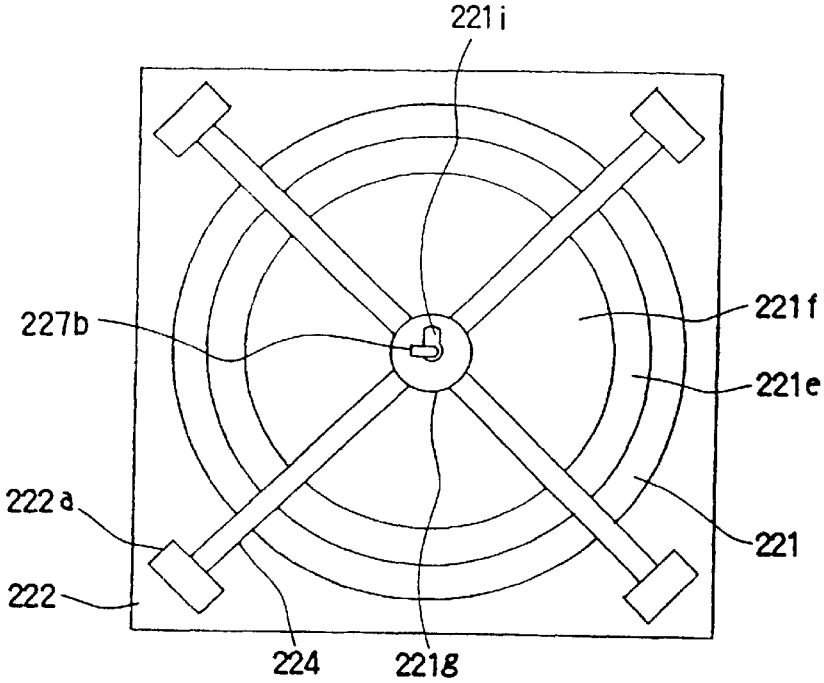
Figure 12B:
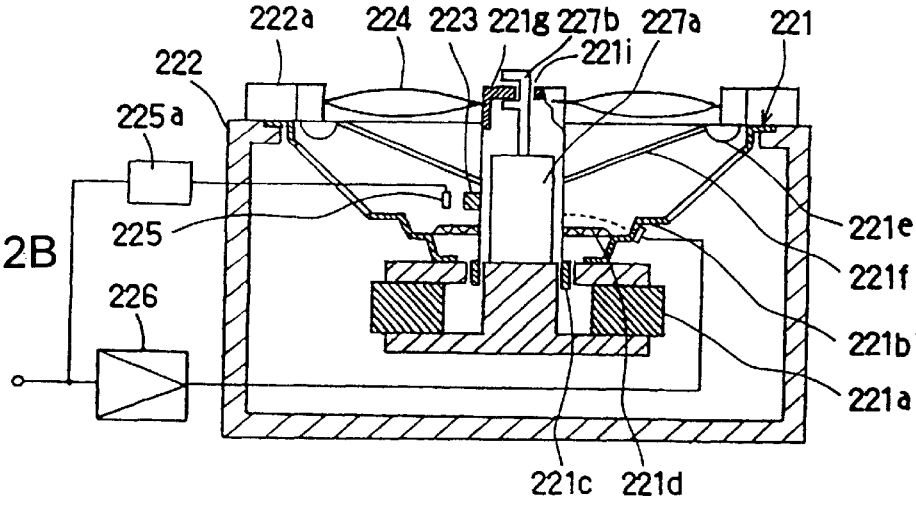

A bass reproduction speaker apparatus in the eighth embodiment of the present invention is explained below referring to FIGS. 12A and 12B.

The bass reproduction speaker apparatus in the eighth embodiment includes a field magnetic portion 221*a*, a frame 221*b*, a voice coil 221*c*, a damper 221*d*, an edge 221*e*, a diaphragm 221*f*, a cabinet 222, stationary part supporting members 222*a*, a movable magnet 223, springs 224, a detector 225, a feedback circuit 225*a*, and a power amplifier 226. Since these components correspond respectively to those in the sixth embodiment shown in FIGS. 9A and 9B, i.e., the field magnetic portion 201*a*, the frame 201*b*, the voice coil 201*c*, the damper 201*d*, the edge 201*e*, the diaphragm 201*f*, the cabinet 202, the stationary part supporting member 202*a*, the movable magnet 203, the springs 204, the detector 205, the feedback circuit 205*a* and the power amplifier 206, and they are identical to each other, further explanation will be omitted.

The eighth embodiment is distinguishable from the sixth embodiment in that the bass reproduction speaker apparatus includes holders (227*a*, 227*b* and 221*g*) to hold the vibration system of the speaker unit 221 around the central position in the displacement direction when the bass reproduction speaker apparatus does not operate.

Numeral 227*a* denotes a small geared motor having a rotation shaft 227*b* protruding from the center of the geared motor. The tip of the shaft 227*b* is bent to form a holding part of an angular U shape in order to sandwich the movable part supporting member 221*g* in the perpendicular direction with some clearance. The movable part supporting member 221*g* doubles as a dust cap, to which the springs 224 are attached. At the center of the movable part supporting member 221*g*, a slit-like loop hole 221*i* is formed. The loop hole 221*i* is a little bigger than the girth of the holding part at the tip of the rotation shaft 227*b* when viewed from the front.

When the bass reproduction speaker apparatus operates, the longitudinal direction of the holding part at the tip of the rotation shaft 227*b* corresponds with the long axis direction of the loop hole 221*i* formed at the movable part supporting member 221*g*. Therefore, the vibration system of the speaker unit 221 can move without having the movable part supporting member 221*g* contact with the holding part at the tip of the rotation shaft 227*b* when the bass reproduction speaker apparatus operates.

When the bass reproduction speaker apparatus does not operate, e.g., when the power source of the bass reproduction speaker apparatus is turned off, the geared motor 227*a* rotates the rotation shaft 227*b* by about tens of degrees. Then the longitudinal direction of the holding part at the tip of the rotation shaft 227*b* crosses the long axis direction of the loop hole 221*i* of the movable part supporting member 221*g* at a predetermined angle as shown in FIGS. 12A and 12B. As a result, the holding part sandwiches the movable part supporting member 221*g* perpendicularly with some clearance, and holds the vibration system of the speaker unit 221 around the central position in the displacement direction.

The control of this geared motor 227*a* can be operated as follows. When the bass reproduction speaker apparatus is turned on, holding of the vibration system is released by rotating the rotation shaft 227*b* after the vibration system of the speaker unit 221 moves from the offset position (i.e., the holding part at the tip of the rotation shaft 227*b* holds the movable part supporting member 221*g* from either the top or bottom side) to the central position in the displacement direction. For several seconds while the rotation shaft 227*b* moves to a predetermined position and stops there, a source input signal of the power amplifier is muted. The series of operations can be carried out easily by using a simple delay circuit or the like.

In order to cope with turning off the bass reproduction speaker apparatus, a relay can be provided inside the apparatus. The relay operates by lagging about one or two seconds behind a main switch actuation. More specifically, only the source input entering the power amplifier is turned off at the moment that the user turns off the main power source. Immediately afterwards, the geared motor 227*a* is operated so that the vibration system of the speaker unit 221 is held around the central position in the displacement direction. After the geared motor 227 stops, the entire power source including the power amplifier 226 and the feedback circuit 225 can be interrupted by using the relay.

The bass reproduction speaker apparatus thus configured in this embodiment can provide effects similar to those in the sixth embodiment. In addition to that, the vibration system of the speaker unit 221 is held around the central position in the displacement direction when the bass reproduction speaker apparatus does not operate. And thus, the vibration system is prevented from being offset to one side over a long time. Therefore, stress caused by stiffness (tension) at the supporting system (e.g., the damper 221*d* or the edge 221*e*) of the speaker unit 221 is avoided, and thus, the vibration system changes or deteriorates less over time.

Problems such as perpendicular asymmetry in the negative stiffness of springs can occur when the springs are kept in a deformation state for a long period. Such a problem also can be avoided in this embodiment since the springs 224 are held in an equilibrium position.

As mentioned above, this embodiment can provide a long-life bass reproduction speaker apparatus with less change over time.

In this embodiment, slight amount of air will leak from the loop hole 221*i* formed on the movable part supporting member 221*g*. It is further preferable that this leakage is prevented by providing an airtight cover on the movable part supporting member 221*g*.

In this embodiment, the vibration system of the speaker unit 221 is held around the central position in the displacement direction by using the tip end of the movable part supporting member 221*g*. Needless to say, the present invention is not limited thereto but other components or members also can be used.

The geared motor 227*a* is used as a means to hold the vibration system of the speaker unit 221 around the central position in the displacement direction in this embodiment, but the motor can be replaced by other means such as a rotating solenoid.

It should be noted that the present invention is not limited to the above-mentioned examples.

(Ninth Embodiment)

A bass reproduction speaker apparatus in the ninth embodiment of the present invention is explained below referring to FIG. 13A and 13B.

The bass reproduction speaker apparatus in the ninth embodiment includes a field magnetic portion 231*a*, a frame 231*b*, a voice coil 231*c*, a damper 231*d*, an edge 231*e*, a diaphragm 231*f*, a movable part supporting member 231*g*, a cabinet 232, stationary part supporting members 232*a*, a movable magnet 233, springs 234, a detector 235, a feedback circuit 235*a*, and a power amplifier 236. Since these components correspond respectively to those in the sixth embodiment shown in FIGS. 9A and 9B, i.e., the field magnetic portion 201*a*, the frame 201*b*, the voice coil 201*c*, the damper 201*d*, the edge 201*e*, the diaphragm 201*f*, the movable part supporting member 201*g*, the cabinet 202, the stationary part supporting member 202*a*, the movable magnet 203, the springs 204, the detector 205, the feedback circuit 205*a* and the power amplifier 206, and they are identical to each other, further explanation will be omitted.

Similar to the eighth embodiment, the ninth embodiment includes a holder to hold the vibration system of the speaker unit 231 around the central position in the displacement direction when the bass reproduction speaker apparatus does not operate. However, the ninth embodiment is distinguishable in that a self-contained solenoid 237*a* is used. The self-contained solenoid 237*a* has a plunger 237*b* protruding from the center of the same solenoid, and the plunger 237*b* moves in the central axis direction. The tip of the plunger 237*b* is formed to fit with a resin holding-fitting member 237*c* attached to a bobbin of the voice coil 231*c*. The plunger 237*b* is equipped with a return spring 237*d*.

When the bass reproduction speaker apparatus starts operating, the plunger 237*b* is attracted at the moment that the self-contained solenoid 237*a* is energized, and the plunger 237*b* is promptly detached from the holding-fitting member 237*c*. Therefore, when the bass reproduction speaker apparatus operates, and the vibration system of the speaker unit 231 can move while the holding-fitting member 237*c* is prevented from contacting with the tip of the plunger 237*b*.

The plunger 237*b* can be kept in an attraction state as the solenoid 237*a* is a self-contained type. Therefore, the power supply can be stopped soon after the attraction. That is, an instant energisation is sufficient.

When the bass reproduction speaker apparatus does not operate, e.g., in the case that the same apparatus is turned off, the self-contained solenoid 237*a* is energized in the inverse direction. In other words, a return current is passed. Then the plunger 237*b* is released from the attraction state, and comes back to the position of the holding-fitting member 237*c* by the force of the return spring 237*d*. In this way, the vibration system of the speaker unit 231 is held around the central position in the displacement direction.

Figure 14:
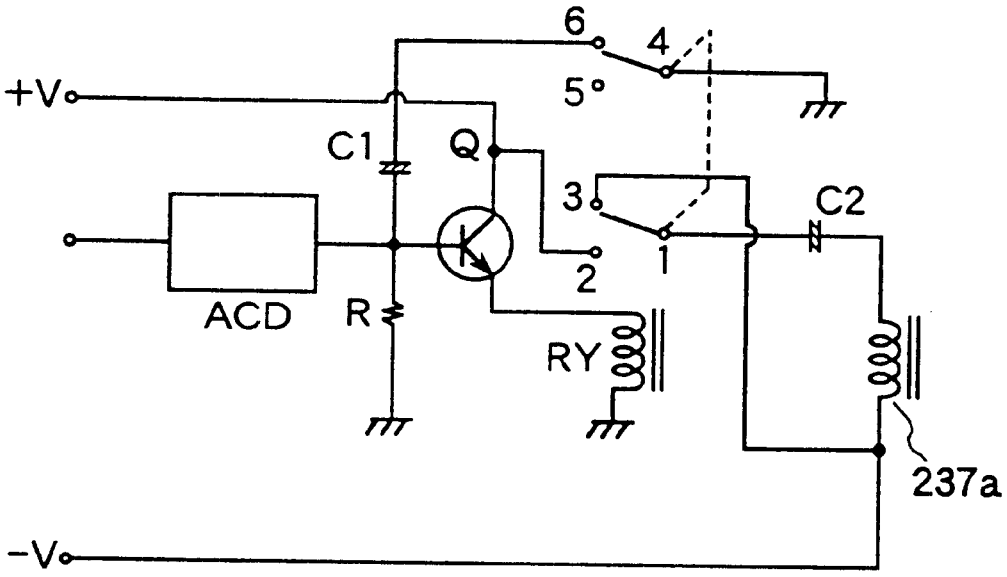
FIG. 14 is a diagram to exemplify a control circuit to control operation of a solenoid in the ninth embodiment.

FIG. 14 is a diagram exemplifying a circuit to control the operation of this self-contained solenoid 237*a*. ACD denotes an AC primary current detection circuit of a bass reproduction speaker apparatus. The coil of the self-contained solenoid 237*a* is energized by using a large capacitor C2. The operation of this control circuit is described below.

When a switch of the bass reproduction speaker apparatus is turned on, the AC primary current detection circuit (ACD) generates a detection electric signal and a current begins to flow in the base of a transistor Q. A capacitor C1 and a resistance R are connected with the transistor Q. Based on this time constant, a relay RY connected to an emitter of the transistor Q operates about one second after the turning-on. This time delay is to wait for the vibration system of the speaker unit 231 to move from the offset position to the central position in the displacement direction.

Then the relay RY becomes ON and the terminals 1 and 2 are connected. Current flows instantaneously from the power source into the self-contained solenoid 237*a* through the capacitor C2, and the self-contained solenoid 237*a* operates to be an attraction state. This current is a charging current for the capacitor C2, but it flows only for a moment. As a result, there is no need continuously to supply current into the self-contained solenoid 237*a*.

When the bass reproduction speaker apparatus is turned off, a detection electric signal is not provided from the AC primary current detection circuit. Therefore, the transistor Q is interrupted and the relay RY becomes OFF. Then the terminals 1 and 3 of the relay RY are connected to each other and the capacitor C2 discharges to the self-contained solenoid 237*a*. At this time, the current flows inversely to the moment that the bass reproduction speaker apparatus is turned on. Since an inverse current flows in the self-contained solenoid 237*a* in this way, the plunger 237*b* can be returned. The terminals 4 and 6 of the relay RY are to discharge the time constant capacitor C1.

The bass reproduction speaker apparatus thus configured in this embodiment can provide effects similar to those in the eighth embodiment. In addition to that, the self-contained solenoid 237*a* operates instantly, so that the apparatus of this embodiment does not take time to operate unlike the geared motor used in the eighth embodiment.

It will be difficult to operate the bass reproduction speaker apparatus promptly after turning on the bass reproduction speaker apparatus if there is no means to hold the vibration system of the speaker unit around the central position in the displacement direction. The reason is as follows. The vibration system is pushed far away from the central position in the displacement direction by the spring force when the bass reproduction speaker apparatus does not operate, and it takes some time before the vibration system returns to the central position.

A separate power source for a return current is not necessary in this embodiment, since operation current of the self-contained solenoid 237*a* is supplied through the capacitor C2 and also the same capacitor discharges to supply a return current of the self-contained solenoid 237*a*. As a result, even when the power is abruptly cut off during the operation of the bass reproduction speaker apparatus, e.g., in a case of blackout or accidental unplugging, the self-contained solenoid 237*a* can be returned to operation by using electric charge stored in the capacitor C2, and thus, the vibration system of the speaker unit 231 can be held around the central position in the displacement direction.

As mentioned above, this embodiment can provide a long-life bass reproduction speaker apparatus with less change over time. In addition, this speaker apparatus can promptly start its operation, and it is safe.

In this embodiment, the plunger 237*b* of the self-contained solenoid 237*a* is set to be a returning state when the bass reproduction speaker apparatus does not operate, but the reverse design is also available.

A self-contained solenoid 237*a* is used in this embodiment, but it can be replaced by an ordinary solenoid or other types of solenoids. However, the self-contained solenoid serves to save power, since only an instant operation current is sufficient.

Figure 13A:
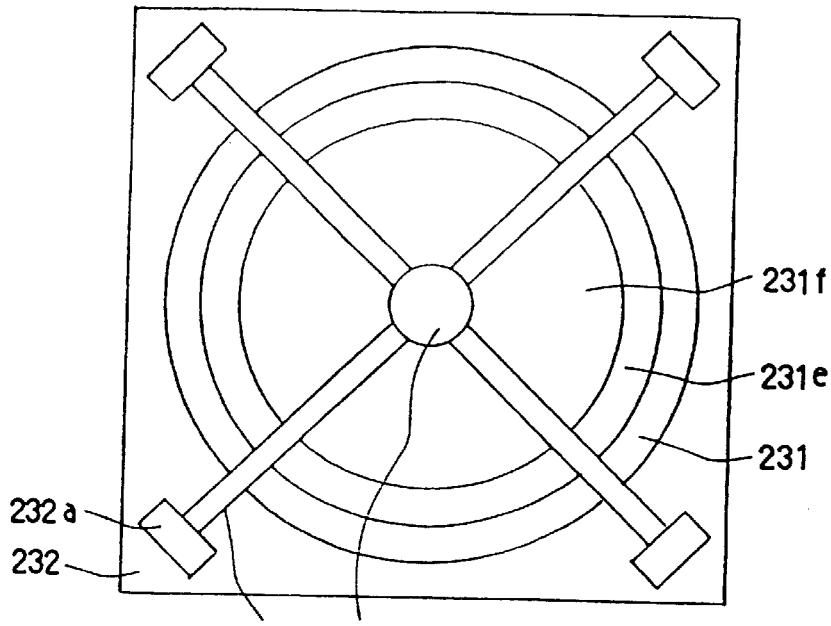
Figure 13B:
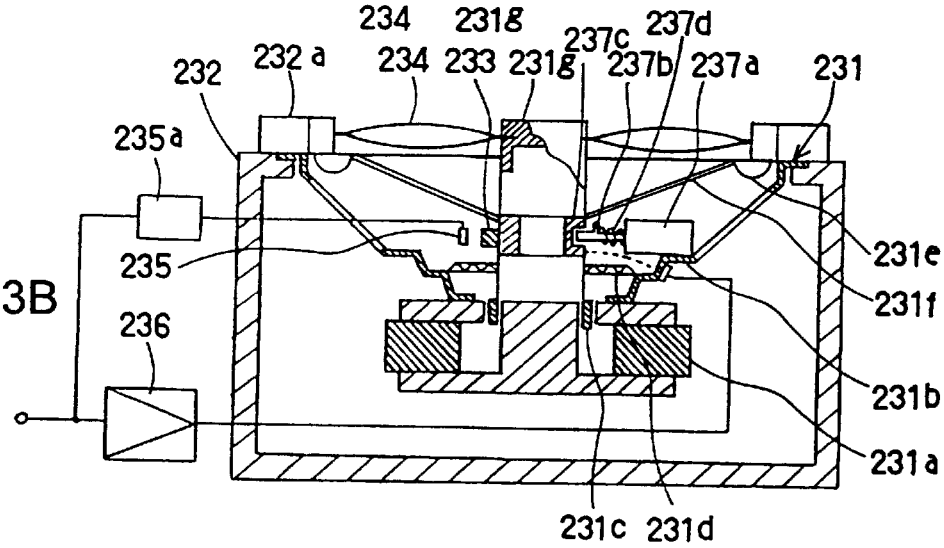
Figure 15:
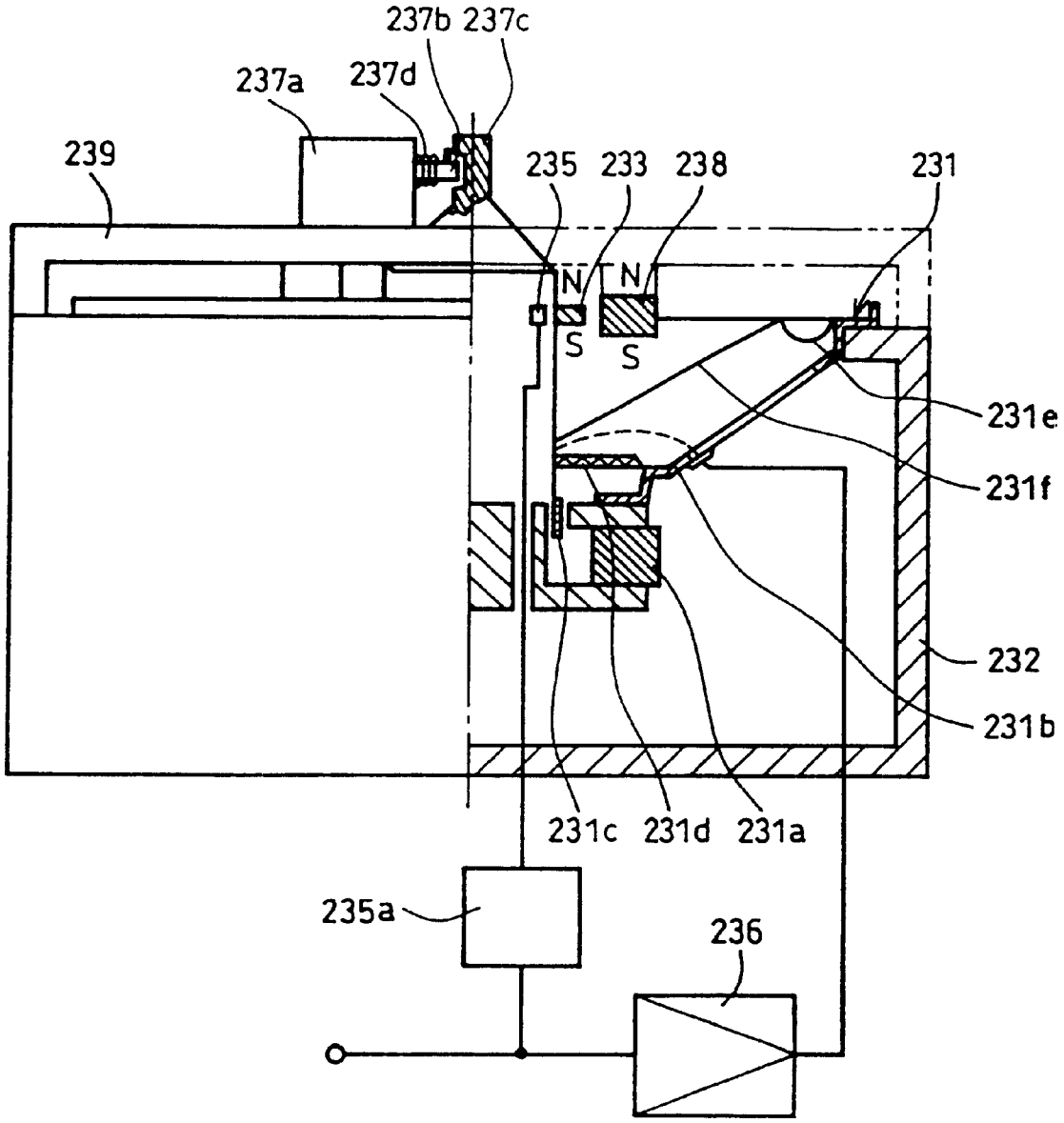
FIG. 15 is a partial cross-sectional view to show a configuration of another bass reproduction speaker apparatus in the ninth embodiment.

The self-contained solenoid 237*a* is placed on the backside of the diaphragm 231*f* in FIG. 13B, but it can be placed on the surface side of the same diaphragm. FIG. 15 shows a bass reproduction speaker apparatus with such a configuration. Identical numbers are given to the members having the similar functions as in FIG. 13B.

In the bass reproduction speaker apparatus shown in FIG. 15, a means to provide negative stiffness includes a movable magnet 233 attached to the outer wall of the bobbin of the voice coil 231*c*, and a stationary magnet 238 attached to a plate 239 provided to the front of the cabinet 232. The movable magnet 233 is ring-like and it moves together with the vibration system of the speaker unit 231. The stationary magnet 238 is also a ring attached outside of the movable magnet 233, and the perpendicular central positions of the two magnets are identical. Both the movable magnet 233 and the stationary magnet 238 are magnetized to have upper N poles and lower S poles, and the magnets repel each other. As a result, negative stiffness is generated as in the first and third embodiments. The Hall element 235 as a detector is vertically arranged in the vicinity of the perpendicular center of the movable magnet 233 inside the bobbin.

The self-contained solenoid 237*a* is placed on the plate 239, and the plunger 237*b* is configured to have a tip that fits with the holding-fitting member 237*c* placed at the tip of the bobbin.

The self-contained solenoid 237*a* of a bass reproduction speaker apparatus thus configured as shown in FIG. 15 can be operated in the same manner as the bass reproduction speaker apparatus in FIGS. 13A and 13B, and similar effects are obtained.

It should be noted that the present invention is not limited to the above-mentioned examples.

(Tenth Embodiment)

A bass reproduction speaker apparatus in the tenth embodiment of the present invention is explained below referring to FIGS. 16A and 16B.

The bass reproduction speaker apparatus in the tenth embodiment includes a field magnetic portion 241*a*, a frame 241*b*, a voice coil 241*c*, a damper 241*d*, an edge 241*e*, a diaphragm 241*f*, a movable part supporting member 241*g*, a cabinet 242, a movable magnet 243, springs 244, a detector 245, a feedback circuit 245*a* and a power amplifier 246. Since these components correspond respectively to those in the sixth embodiment shown in FIGS. 9A and 9B, i.e., the field magnetic portion 201*a*, the frame 201*b*, the voice coil 201*c*, the damper 201*d*, the edge 201*e*, the diaphragm 201*f*, the movable part supporting member 201*g*, the cabinet 202, the movable magnet 203, the springs 204, the detector 205, the feedback circuit 205*a* and the power amplifier 206, and they are identical to each other, further explanation will be omitted.

The bass reproduction speaker apparatus in the tenth embodiment is characterized in that it includes movable rods 242*b* in the stationary part supporting members 242*a* while the springs 244 are fixed to the movable rods 242*b* for support, so that negative stiffness of the springs 244 can be varied.

Figure 16A:
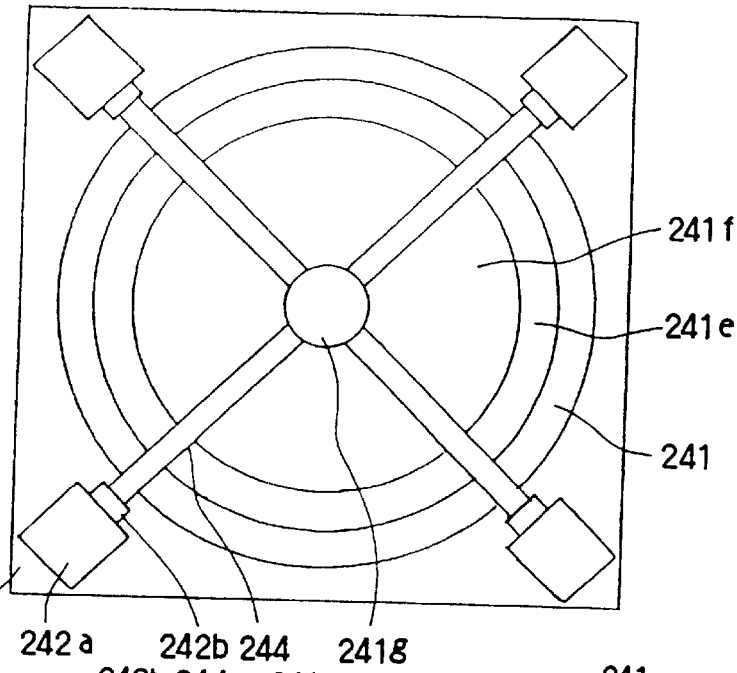
Figure 16B:
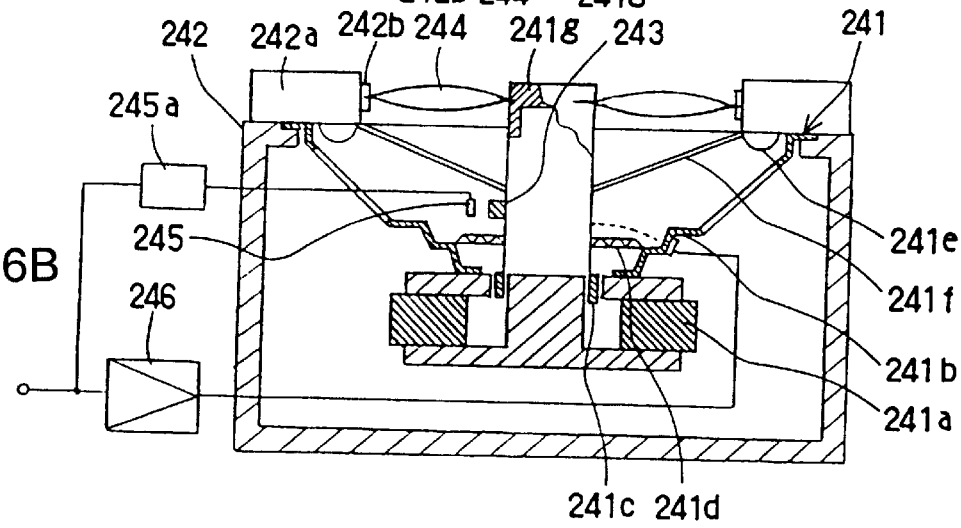
Figure 17:
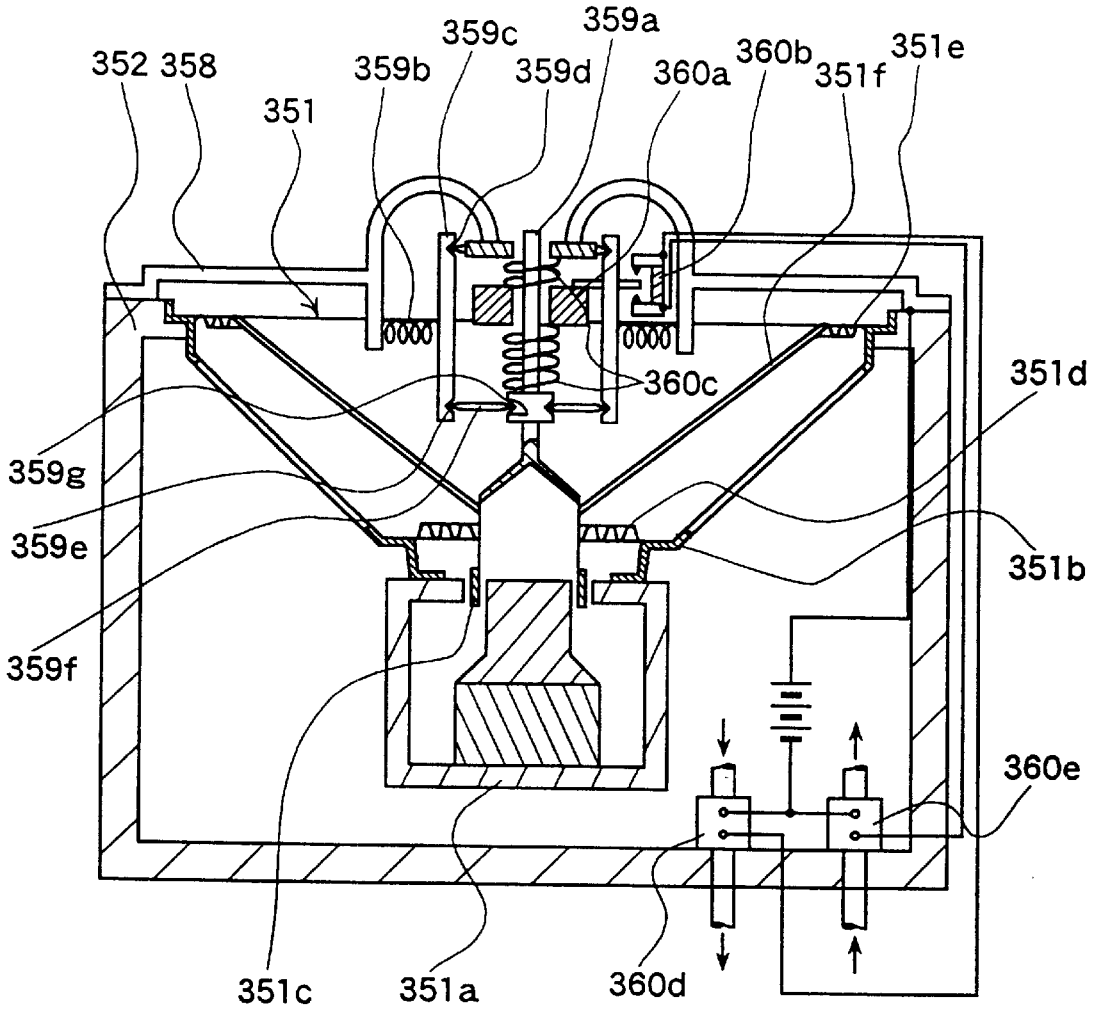
FIG. 17 PRIOR ART
FIG. 17 is a cross-sectional view to show a configuration of a conventional bass reproduction speaker apparatus.

More specifically, the four stationary part supporting members 242*a* in FIGS. 16A and 16B contain a movable mechanism to advance in the axial direction, and the mechanism includes a motor, a worm gear, a rack gear and the like. When the motor stops rotating, both the worm gear and the rack gear cannot move even if the movable rods 242*b* are subject to compression. Therefore, the movable rods 242*b* work as stationary fixed ends.

When the bass reproduction speaker apparatus does not operate, the movable rods 242*b* are moved back to loose the springs 244. When the same apparatus operates, the movable rods 242*b* are moved forward to provide a predetermined compression to the springs 244.

At this time, the stationary positions for the movable rods 242*b* are adjusted to control the compression applied to the springs 244, and thus, the generated negative stiffness can be varied.

The bass reproduction speaker apparatus thus configured in this embodiment can provide effects similar to those in the sixth embodiment. In addition to that, negative stiffness of the springs 244 can be decreased when the apparatus does not operate. Therefore, stress caused by stiffness (tension) at the supporting system (e.g., the damper 241*d* or the edge 241*e*) of the speaker unit 241 is avoided, and thus, the supporting system changes or deteriorates less over time.

Since the negative stiffness generated by the springs 244 can be adjusted, the fundamental resonance frequency of the bass reproduction speaker apparatus can be adjusted and the bass characteristic can be varied.

As mentioned above, this embodiment can provide a bass reproduction speaker apparatus with a long life and less change over time, and the same apparatus has a variable bass characteristic.

In the tenth embodiment, negative stiffness is provided by a mechanical means. i.e., the springs 244, but similar functions can be provided if the mechanical means is replaced by a magnetic means as mentioned in the seventh embodiment. In such a case, for example, the stationary magnet is made of an electromagnet and a current supplied to the electromagnet is adjusted to vary the generated negative stiffness.

It should be noted that the present invention is not limited to the above-mentioned examples.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A bass reproduction speaker apparatus comprising a speaker unit having a vibration system, a cabinet to which the speaker unit is attached, a movable magnet that moves together with the vibration system of the speaker unit, and a stationary magnet;

wherein the movable magnet and the stationary magnet are configured to generate negative stiffness to the vibration system of the speaker unit, the stationary magnet is ring-like, and the movable magnet is arranged at an inner radius of the stationary magnet.

2. The bass reproduction speaker apparatus according to claim 1, wherein the movable magnet and the stationary magnet are configured so that the generated negative stiffness is decreased before the displacement of the vibration system of the speaker unit reaches a maximum.

3. The bass reproduction speaker apparatus according to claim 1, further comprising a detector to generate a signal corresponding to displacement of the vibration system of the speaker unit in order to feed back the signal from the detector to a power amplifier for driving the speaker unit and to correct an offset in the displacement direction of the vibration system of the speaker unit.

4. The bass reproduction speaker apparatus according to claim 3, wherein the detector comprises a Hall element.

5. The bass reproduction speaker apparatus according to claim 1, further comprising a holder to hold the vibration system of the speaker unit around the central position in the displacement direction when the bass reproduction speaker apparatus is out of operation.

6. The bass reproduction speaker apparatus according to claim 1, wherein the stationary magnet is an electromagnet.

7. A bass reproduction speaker apparatus comprising a speaker unit having a vibration system, a means to provide negative stiffness to the vibration system of the speaker unit, a cabinet to which the speaker unit is attached, a detector to generate a signal corresponding to displacement of the vibration system of the speaker unit, a feedback circuit to feed back the signal from the detector to a power amplifier supplying source signal power for driving the speaker unit; and a holder to hold the vibration system of the speaker unit around the central position in the displacement direction when the bass reproduction speaker apparatus is out of operation, wherein the power amplifier supplies the speaker unit with power to correct an offset in the displacement direction of the vibration system of the speaker unit in addition to the source signal power.

8. The bass reproduction speaker apparatus according to claim 7, wherein the detector comprises a movable magnet that moves together with the vibration system of the speaker unit and a Hall element to detect magnetism of the movable magnet.

9. The bass reproduction speaker apparatus according to claim 7, wherein the means to provide negative stiffness comprises springs that are attached at plural positions in a compressed state with a substantial symmetry about a central axis between a part around the central position of the vibration system of the speaker unit and either a part around the outer rim of the speaker unit or the cabinet.

10. The bass reproduction speaker apparatus according to claim 7, wherein the means to provide negative stiffness comprises a movable magnet that moves together with the vibration system of the speaker unit and a stationary magnet to provide a force in the displacement direction of the vibration system to the movable magnet.

11. The bass reproduction speaker apparatus according to claim 7, wherein holder comprises a self-contained solenoid.

12. The bass reproduction speaker apparatus according to claim 11, wherein a return current of the self-contained solenoid is supplied by discharging a capacitor while an operation current of the self-contained solenoid is supplied through the same capacitor.

13. The bass reproduction speaker apparatus according to claim 7, wherein the negative stiffness provided by the means is decreased when the bass reproduction speaker apparatus is out of operation.

14. The bass reproduction speaker apparatus according to claim 7, wherein the negative stiffness provided by the means is variable.

* * * * *